US011242665B1

(12) United States Patent
Strom et al.

(10) Patent No.: US 11,242,665 B1
(45) Date of Patent: Feb. 8, 2022

(54) PORTABLE COFFERDAM ASSEMBLY SYSTEM

(71) Applicant: Subsurface, Inc., Moorhead, MN (US)

(72) Inventors: Brandon G. Strom, Vergas, MN (US); Gary H. Strom, Moorhead, MN (US)

(73) Assignee: Subsurface, Inc., Fargo, ND (US)

( * ) Notice: Subject to any disclaimer, the term of this patent is extended or adjusted under 35 U.S.C. 154(b) by 0 days.

(21) Appl. No.: 17/333,269

(22) Filed: May 28, 2021

(51) Int. Cl.
*E02D 19/04* (2006.01)
*E02D 5/08* (2006.01)

(52) U.S. Cl.
CPC ..... *E02D 19/04* (2013.01)

(58) Field of Classification Search
CPC ..... E02D 19/02; E02D 19/04; E02D 27/30
See application file for complete search history.

(56) References Cited

U.S. PATENT DOCUMENTS 1,806,967 A * 5/1931 Dougherty ..... E02D 5/04 405/278
1,837,787 A * 12/1931 Meiser ..... E02D 5/08 405/279
2,050,934 A * 8/1936 Ditchburn ..... E02D 5/04 405/281
3,688,508 A * 9/1972 Taylor ..... E02D 5/08 405/278
3,822,557 A * 7/1974 Frederick ..... E02D 5/72 405/248
4,028,901 A * 6/1977 Barber ..... E02D 13/02 405/277
4,202,649 A 5/1980 Cook
5,304,015 A * 4/1994 Sonomura ..... E02D 7/06 405/232
5,938,375 A * 8/1999 Wheeler, Jr. ..... E02D 5/06 405/274
6,053,666 A * 4/2000 Irvine ..... E02D 5/02 405/274
8,926,229 B1 1/2015 Clair
9,945,091 B1 4/2018 Strom
10,100,483 B2 10/2018 Strom
10,435,860 B1 10/2019 Strom
10,794,033 B2 10/2020 Strom
2002/0054791 A1* 5/2002 Nottingham ..... E02D 5/04 405/285

(Continued)

OTHER PUBLICATIONS https://en.wikipedia.org/wiki/Cofferdam; Wikipedia Cofferdam Webpage Article; Printed & Received Sep. 28, 2016.

*Primary Examiner* — Benjamin F Fiorello
(74) *Attorney, Agent, or Firm* — Neustel Law Offices

(57) ABSTRACT

A system for assembling a cofferdam. In a first example embodiment, a cofferdam may be assembled on-site using a plurality of walls that couple each other to form the cofferdam. In a second example embodiment, a plurality of walls and a plurality of connectors may be assembled to form the cofferdam. The walls and/or connectors disassembled for transport and/or storage, yet quickly assembled on-site to form the cofferdam. The panels and/or the connectors may form cofferdams of various shapes and sizes. The walls and/or connectors are made of a durable material that permits multiple uses. The cofferdam may be assembled to hold back the water of a body of water from around a culvert while work or repairs are performed.

20 Claims, 22 Drawing Sheets

(56) References Cited

U.S. PATENT DOCUMENTS

| | | | | |
|---|---|---|---|---|
| 2003/0053869 | A1* | 3/2003 | Moulin | E02D 5/14 405/274 |
| 2005/0226690 | A1* | 10/2005 | MacDonald | E02D 5/08 405/274 |
| 2006/0002768 | A1 | 1/2006 | Meyer | |
| 2016/0108599 | A1 | 4/2016 | Spry | |
| 2018/0106008 | A1* | 4/2018 | Strom | E02D 17/08 |

* cited by examiner

PORTABLE COFFERDAM ASSEMBLY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to cofferdams for holding back water.

Cofferdams have been used for centuries to divert, retain, or hold back water. Cofferdams have been made from earth, wood, sandbags, steel, and inflatable bladders. The users of cofferdams could benefit from a cofferdam system that is portable and is capable of rapid on-site assembly and disassembly.

SUMMARY

Some of the various embodiments of the present disclosure relate to a cofferdam that can be assembled on-site and disassembled for transport or storage. When assembled, the cofferdam can hold back the waters from a body of water to create a dry working area near the shore of the body of water. The dry working area may surround (e.g., enclosed) the inlet of a culvert that serves as an overflow drain to the body of water. The dry working area created by the cofferdam enables men and machinery to access the culvert to perform repairs. Even though the example embodiments of cofferdams discussed herein show creating a dry workspace around a culvert, the portable cofferdam assembly system disclosed herein may be used to divert or hold back waters in any situation, such as to divert water from flowing under a bridge, to hold back water from flowing down a ditch, to create a dry working area in the middle of a body of water, or in any other situation where water needs to be held back or diverted.

Some of the various embodiments of the present disclosure include walls with a first coupler connected to a first end of the wall and a second coupler connected to a second end of the wall. The couplers may be male couplers or female couplers to facilitate coupling the walls together to form the cofferdam. The walls may be couple together to form a cofferdam of a variety of shapes, preferably a U-shape, that surrounds the inlet of the culvert. In some embodiments, the cofferdam is formed using three walls (e.g., a first wall, a second wall, a third wall). In some embodiments, the cofferdam is formed using a plurality of walls. In some other embodiments, the cofferdam is formed using three walls (e.g., the first wall, the second wall, the third wall) and two connectors (e.g., a first connector, a second connector). The connectors include couplers to facilitate connecting adjacent walls to the connector. In some other embodiments, the cofferdam is formed using a plurality of walls and a plurality of connectors.

Construction equipment may be used to position and install the walls and/or connectors to form the cofferdam.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview.

Some of the various embodiments of the present disclosure relate to a cofferdam that may be assembled on-site. Some of the various embodiments of the present disclosure include walls, or walls and connectors that may be connected to each other to form the cofferdam. The cofferdam may be used to wall off the water of a body of water, so that a dry work area may be created.

Figure 1A:
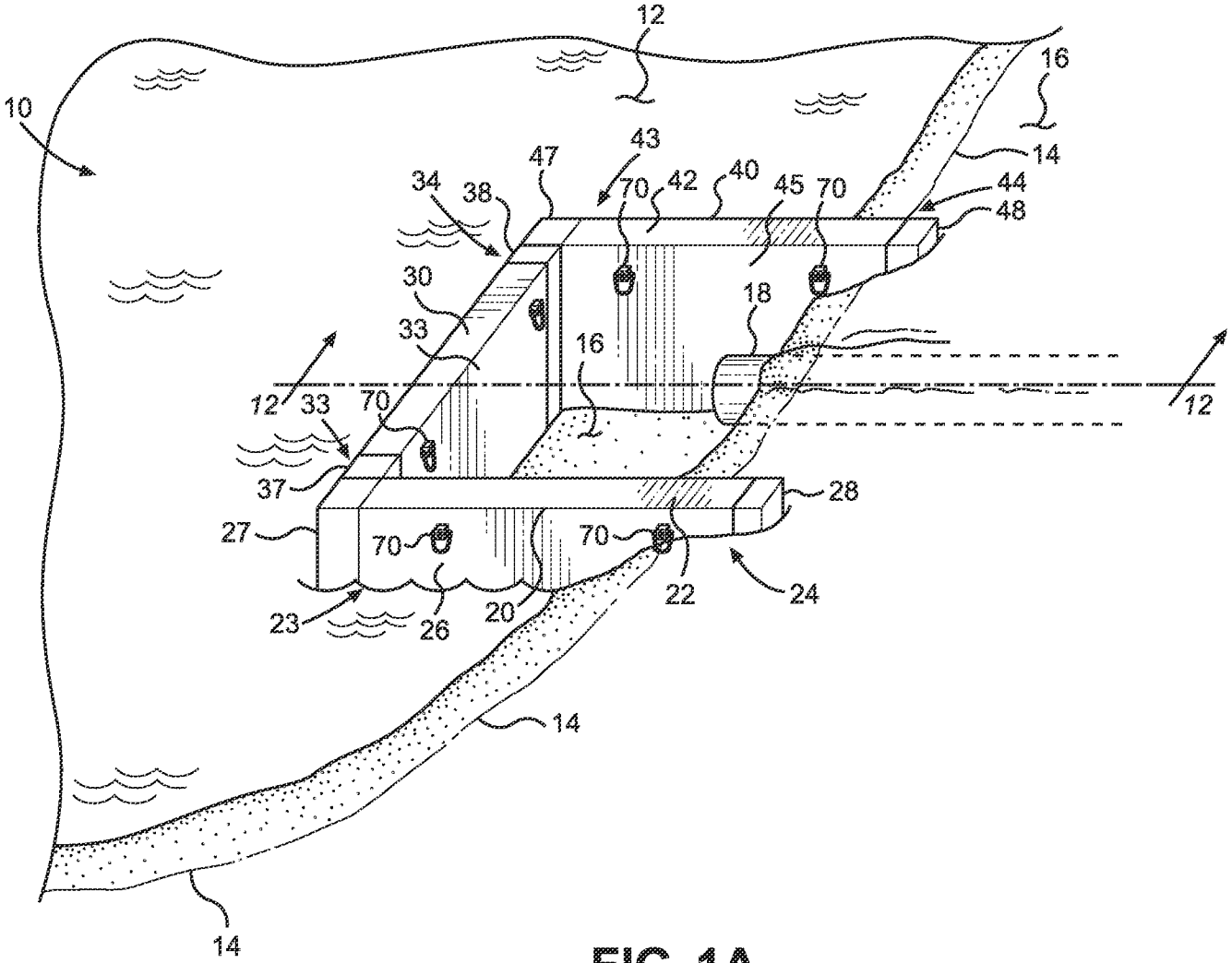
FIG. 1A is a perspective view of an assembled cofferdam in accordance with an example embodiment of the disclosure.

For example, as best shown in FIG. 1A, a cofferdam may be assembled around the inlet of the culvert 18 that provides drainage for the body of water 10. The cofferdam surrounds the inlet of the culvert 18. The water 12 is pumped out of the interior of the cofferdam so that the area around the inlet to the culvert 18 is dry. The dry area inside the cofferdam enables men and equipment access to the culvert 18 to perform work or repairs. The cofferdam holds back the water 12 from the body of water 10 so that the interior of the cofferdam remains dry while the work is performed. Once the cofferdam is removed, the water 12 from the body of water 10 again surrounds the culvert 18.

Figure 20:
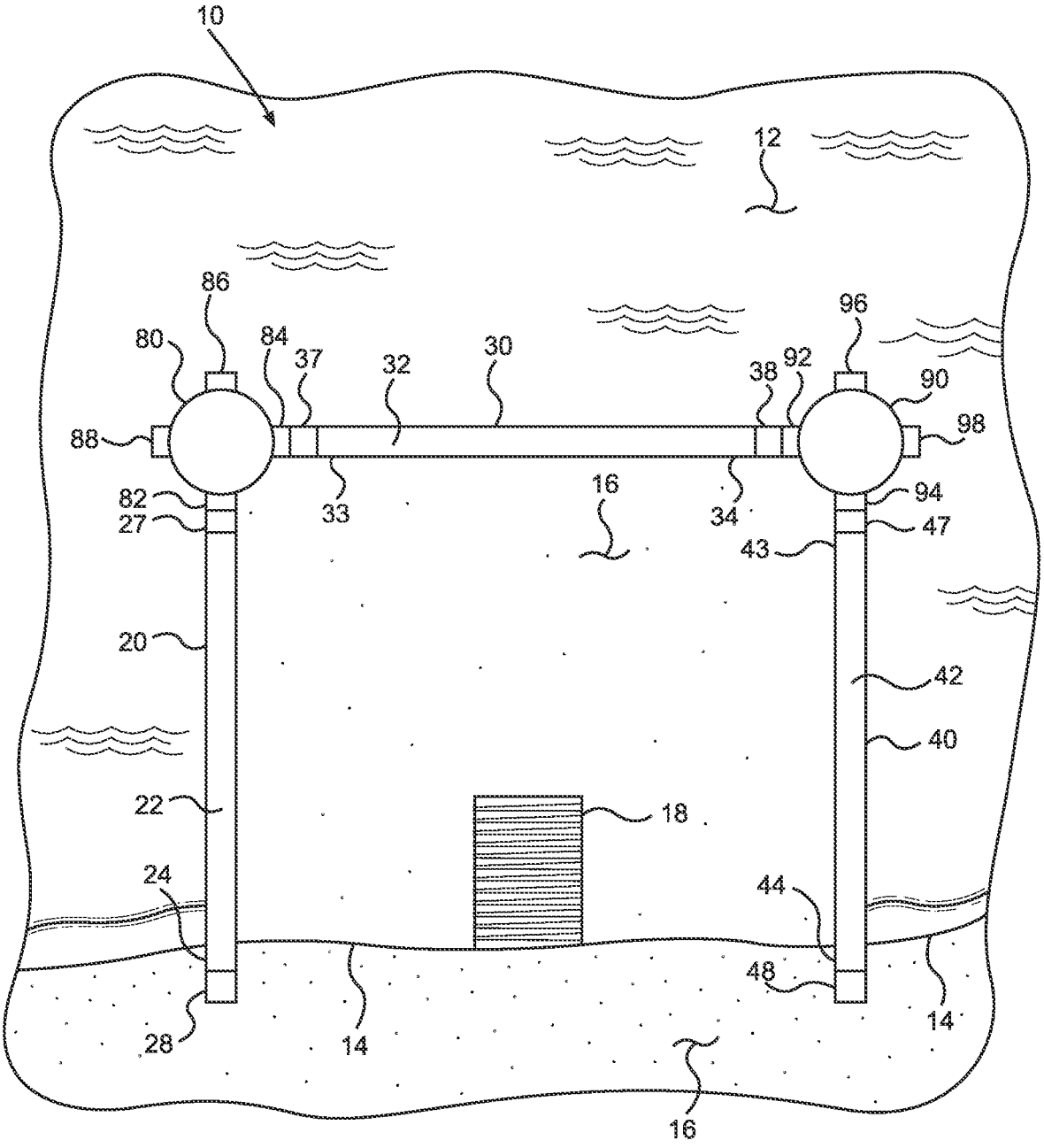
FIG. 20 is a top view of a second embodiment of the cofferdam assembled using walls and the first embodiment of the connector.
Figure 21:
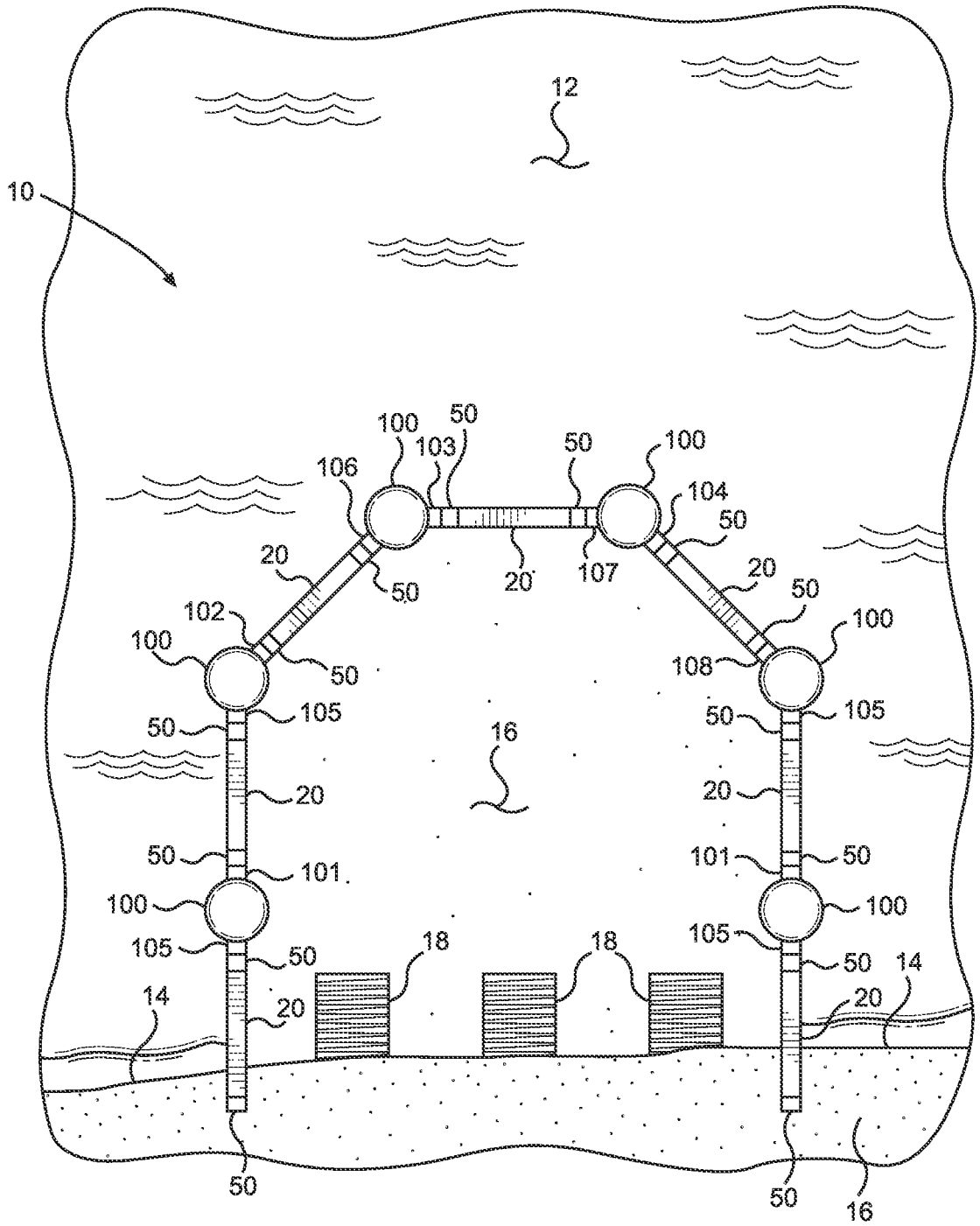
FIG. 21 is a top view of a second embodiment of the cofferdam assembled using walls and the second embodiment of the connector.

In some example embodiments, as best shown in FIGS. 1A-1G, a cofferdam may be formed of three walls (e.g., a first wall 20, a second wall 30, a third wall 40) that are assembled together in a U-shape around the inlet of the culvert 18. In some other example embodiments, as best shown in FIGS. 20-21, a plurality of walls and a plurality of connectors are assembled in a U-shape to form the cofferdam around one or more culverts 18.

The walls and/or the connectors used to form the cofferdam may be disassembled for transport and/or storage. The walls and the connectors are durable and may be assembled and disassembled multiple times.

B. Walls.

The example embodiments of the walls used to assemble a cofferdam include a first end (e.g., 23, 33, 43), a second end (e.g., 24, 34, 44), an upper edge (e.g., 22, 32, 42), a lower edge (e.g., 21, 31, 41), a first coupler (e.g., 27, 37, 47) connected to or near the first end (e.g., 23, 33, 43) and a second coupler (e.g., 28, 38, 48) connected to or near the second end (e.g., 24, 34, 44). The couplers of the walls permit the walls to be connected to each other, or to connectors (e.g., 80, 90, 100), to assemble the cofferdam. For example, the first coupler 27 of a first wall 20 couples to the first coupler 37 of a second wall 30, and the second coupler 38 of the second wall 30 couples to the first coupler 47 of a third wall 40. Any number of walls may be assembled to form the cofferdam, so any number of walls may connect to each other in series to form the cofferdam.

The example embodiments of the first wall 20, the second wall 30 and the third wall 40 shown in FIGS. 1A-1G, 2-3 and 20-21 show the first coupler and the second coupler for each wall in a generic form. The first coupler and the second coupler of a wall may be a male coupler 50 or a female coupler 60. The male coupler 50 and the female coupler 60 are configured to couple to each other thereby allowing walls to be coupled to each other.

The embodiments of the first wall 20, the second wall 30 and the third wall 40 shown in FIGS. 4-16 show the first example embodiment of the male coupler 50 and the female coupler 60. The shape (e.g., male, female) of the first example embodiment of the male coupler 50 and the female coupler 60 complement each other to facilitate coupling. Any complementary shapes may be used to facilitate the coupling of the male coupler 50 to the female coupler 60, and thereby of one wall to another wall.

A wall (e.g., 20, 30, 40) is generally formed of a monolithic piece of material. Two or more distinct pieces of material may be permanently joined to form the monolithic piece of material for the wall. For example, two plates (e.g., sheets) of metal may be welded together to form the single plate that forms the wall. The material that forms the wall is impervious to water. The material that forms the wall may be flat (e.g., plate, sheet), curved, corrugated, or have some other shape. The thickness of the wall may be significantly less than the width and/or the height of the wall. In an example embodiment, the wall is formed of metal plate that is between ¼" and 1" thick, 4' to 12' in width and 6' to 14' tall. In an example embodiment, a wall (e.g., 20, 30, 40) is formed of a ½" steel plate that is 8' wide and between 12' and 14' tall.

Figure 17:
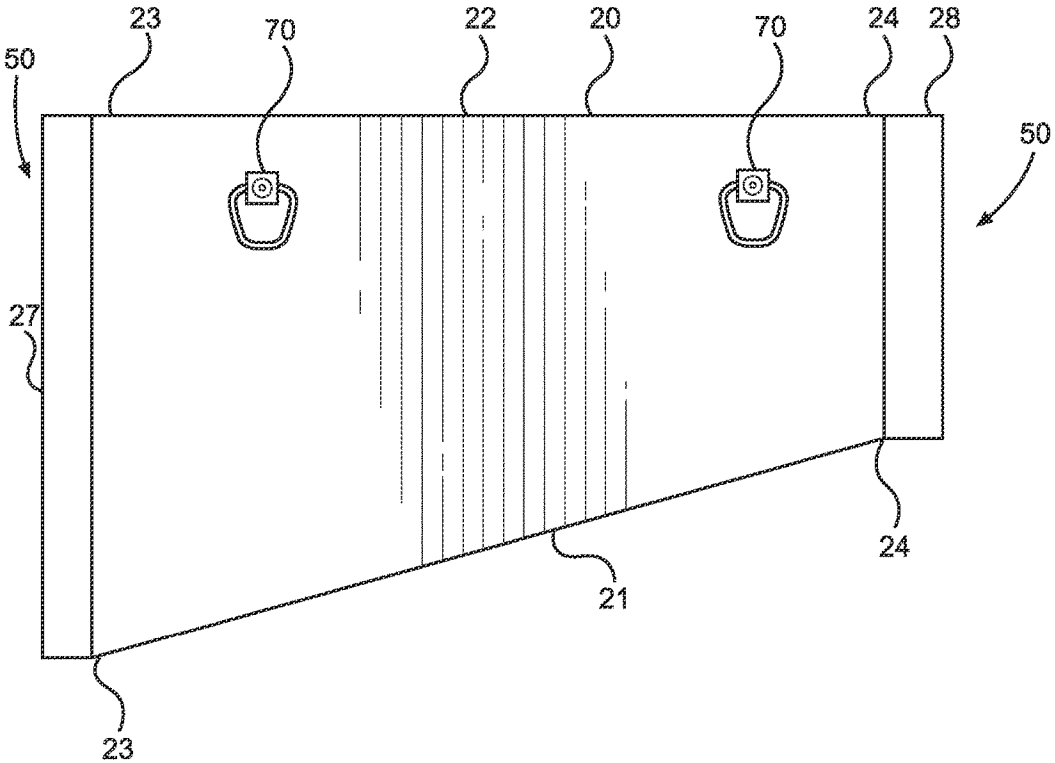
FIG. 17 is a side view of an example embodiment of the first wall with a tapered lower edge.

The shape of the wall may be square, rectangular or tapered. The first wall 20, the second wall 30 and the third wall 40 are shown in FIGS. 1A-1G, 2-4, 7, 11 and 13 are rectangular in shape. The shape of the first wall 20 shown in FIG. 17 is tapered. In this example of a tapered wall, the lower edge 21 is angled with respect to upper edge 22, so the height of the first wall 20 decreases from the second end 24 to the first end 23. The lower edge (e.g., 21, 31, 41) and/or the upper edge (e.g., 22, 32, 42) of the wall may taper.

The first coupler (e.g., 27, 37, 47) and/or the second coupler (e.g., 28, 38, 48) of the wall (e.g., 20, 30, 40) may be formed separately from the wall and connected (e.g., welded) thereto or the first coupler and/or the second coupler may be integral to the wall. The first coupler (e.g., 27, 37, 47) and the second coupler (e.g., 28, 38, 48) may extend (e.g., protrude) from or near the first end (e.g., 23, 33, 43) and the second end (e.g., 24, 34, 44) respectively.

Although a cofferdam may be assembled from any number of walls (e.g., 20, 30, 40) and/or connectors (e.g., 80, 90, 100), one of the example embodiments most extensively discussed herein, as best shown in FIGS. 1A-1G, includes three walls. It should also be understood that a cofferdam may be assembled using 2, 3, 4, 5, 6 or more walls.

The first wall 20, as best shown in FIGS. 1A-1G, 3-6, 10-11, 16-17, and 20 includes a first end 23, a second end 24, a lower edge 21, an upper edge 22, a first coupler 27 connected to or near the first end 23 and a second coupler 28 connected to or near the second end 24.

The second wall 30, as best shown in FIGS. 1A-1G, 2, 7-11, 14-16 and 20 includes a first end 33, a second end 34, a lower edge 31, an upper edge 32, a first coupler 37 connected to or near the first end 33 and a second coupler 38 connected to or near the second end 34.

The third wall 40, as best shown in FIGS. 1A-1G, 2, 13-15 and 20 includes a first end 43, a second end 44, a lower edge 41, an upper edge 42, a first coupler 47 connected to or near the first end 43 and a second coupler 48 connected to or near the second end 44.

The cofferdam includes the first wall 20, the second wall 30 and the third wall 40. When assembled, the first coupler 27 of the first wall 20 couples to the first coupler 37 of the second wall 30. The second coupler 38 of the second wall 30 couples to the first coupler 47 of the third wall 40. The first wall 20, the second wall 30 and the third wall 40 form a U-shape around the culvert 18. In other words, the first wall 20, the second wall 30 and the third wall 40 are positioned in a U-shape from the first side of the inlet of the culvert 18 to a second side of the inlet of the culvert 18. The walls 20, 30 and 40 surround the inlet of the culvert 18. The second coupler 28 (e.g., second end 24) of the first wall 20 and the second coupler 48 (e.g., second end 44) of the third wall 40 are positioned at the uppermost part of the U-shape. The ground surface 16 of the shore 14 is positioned across the uppermost part of the U-shaped.

The lower edges 21, 31 and 41 of the first wall 20, second wall 30 and third wall 40 are positioned below the ground surface 16. The upper edges 22, 32 and 42 are positioned at least above the level of the water 12 of the body of water 10 and preferably above the level of the ground surface 16 along the shore 14.

The interior side 25 of the first wall 20, the interior side 35 of the second wall 30 and the interior side 45 of the third wall 40 form the interior of the cofferdam. The interior sides 25, 35 and 45 are positioned toward the culvert 18, so the inlet of the culvert 18 is positioned in the interior of the cofferdam.

The exterior side 26 of the first wall 20, the exterior side 36 of the second wall 30 and the exterior side 46 of the third wall 40 face outward from the culvert 18 to form the exterior of the cofferdam. The exterior of the cofferdam contacts the water 12 of the body of water 10. The exterior sides 26, 36 and 46 holdback the water 12 from the body of water 10, so that the interior of the cofferdam may be evacuated of the water 12 down to the ground surface 16.

As discussed above, the walls 20, 30 and 40 are formed of a material that is impervious to water, so the water 12 cannot pass through walls 20, 30 and 40 to enter into the interior of the cofferdam. Because the lower edges 21, 31 and 41 are positioned below the ground surface 16, the ground seals around the lower edges 21, 31 and 41, so the water 12 cannot pass underneath the walls 20, 30 and 40 to enter into the interior of the cofferdam. Coupling the first or second coupler of one wall to the first or second coupler of another wall, brings the couplers into physical contact with each other so that they seal against each other. The seal between the couplers may not be completely impervious to water, but they resist the passage of almost all of the water 12 through the couplers into the interior of the cofferdam.

As a result of the water resistance of the walls 20, 30 and 40, and the couplers thereof, the assembled cofferdam is nearly completely resistant to the passage of the water 12 from the exterior of the cofferdam into the interior of the cofferdam. So, once the water 12 is evacuated from the interior of the cofferdam, the ground surface 16 on the interior the cofferdam can dry out to provide a dry workspace.

Figure 1B:
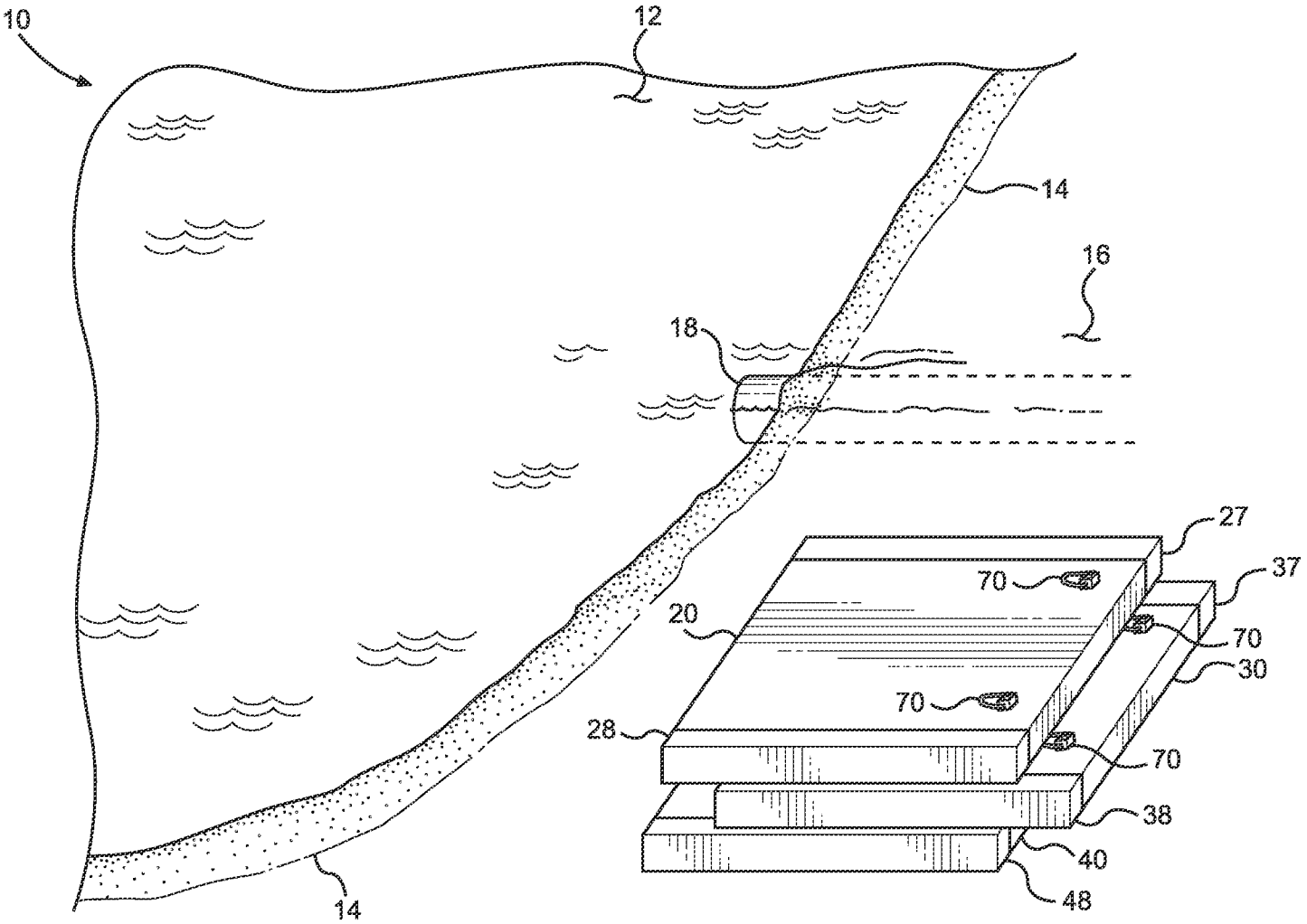
FIG. 1B is a perspective view of the example embodiment of the cofferdam prior to on-site assembly.
Figure 1C:
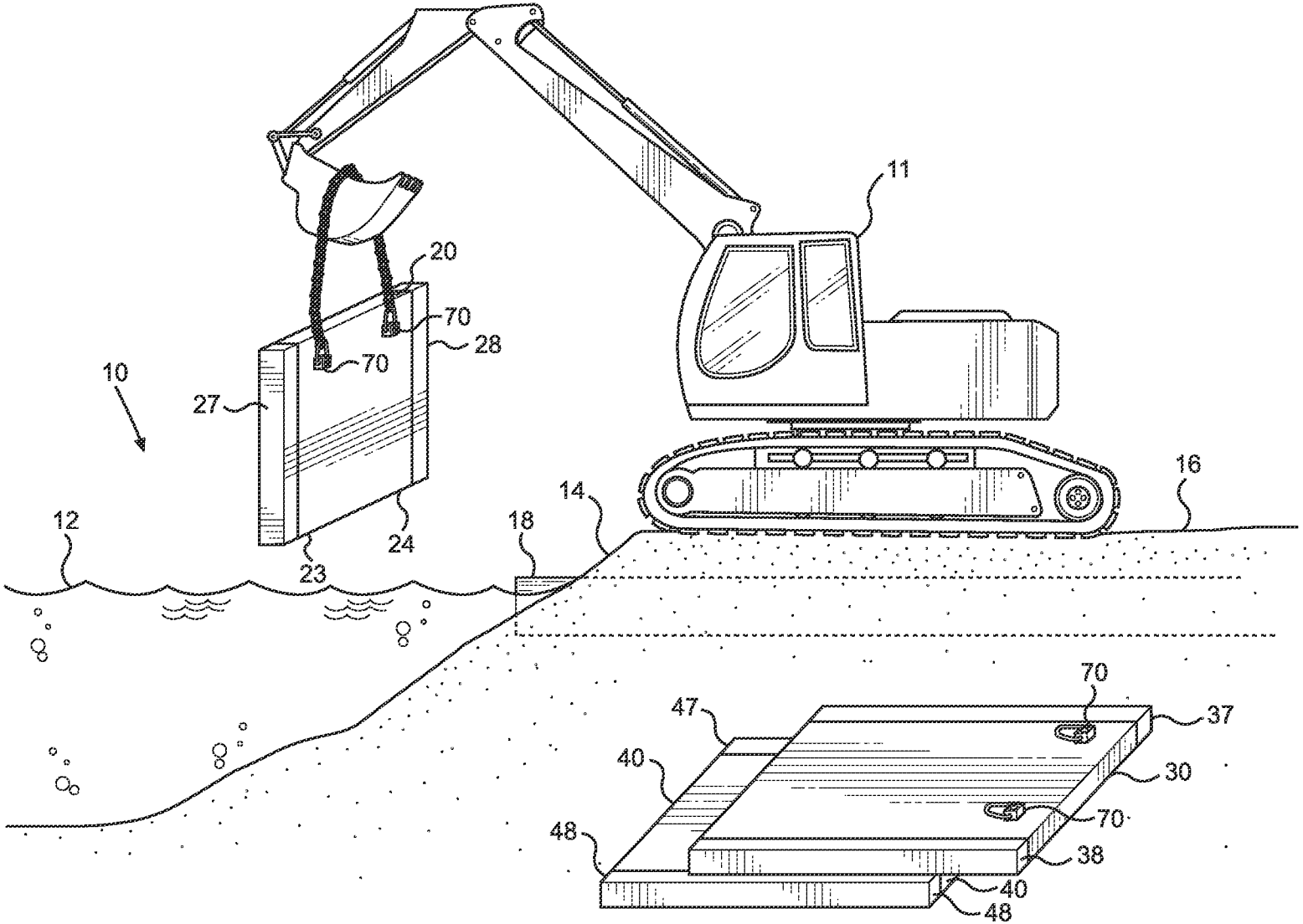
FIG. 1C is a perspective view of positioning the first wall of the example embodiment of the cofferdam.
Figure 1D:
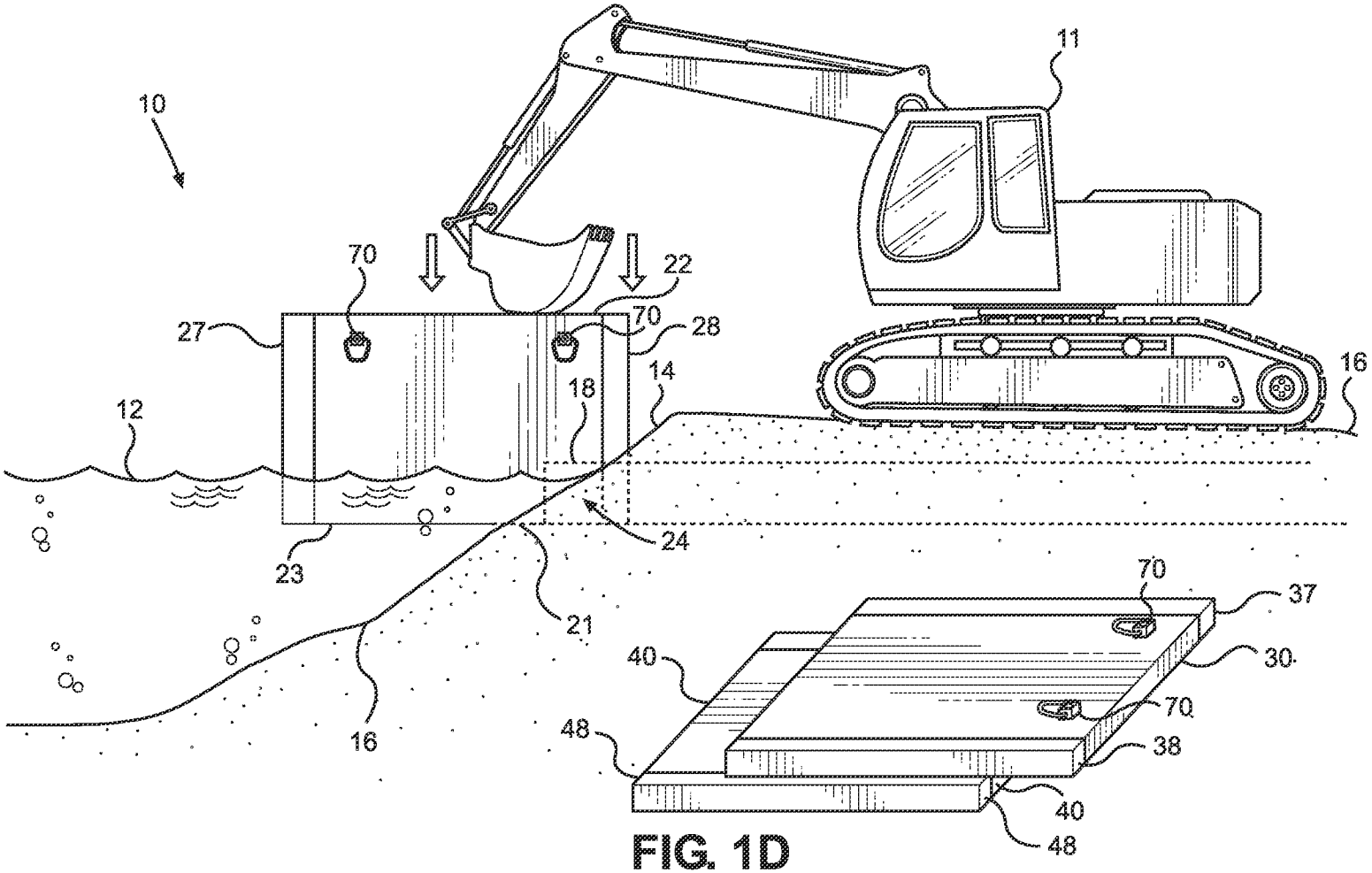
FIG. 1D is a perspective view of pressing downward on the first wall of the example embodiment of the cofferdam
Figure 1E:
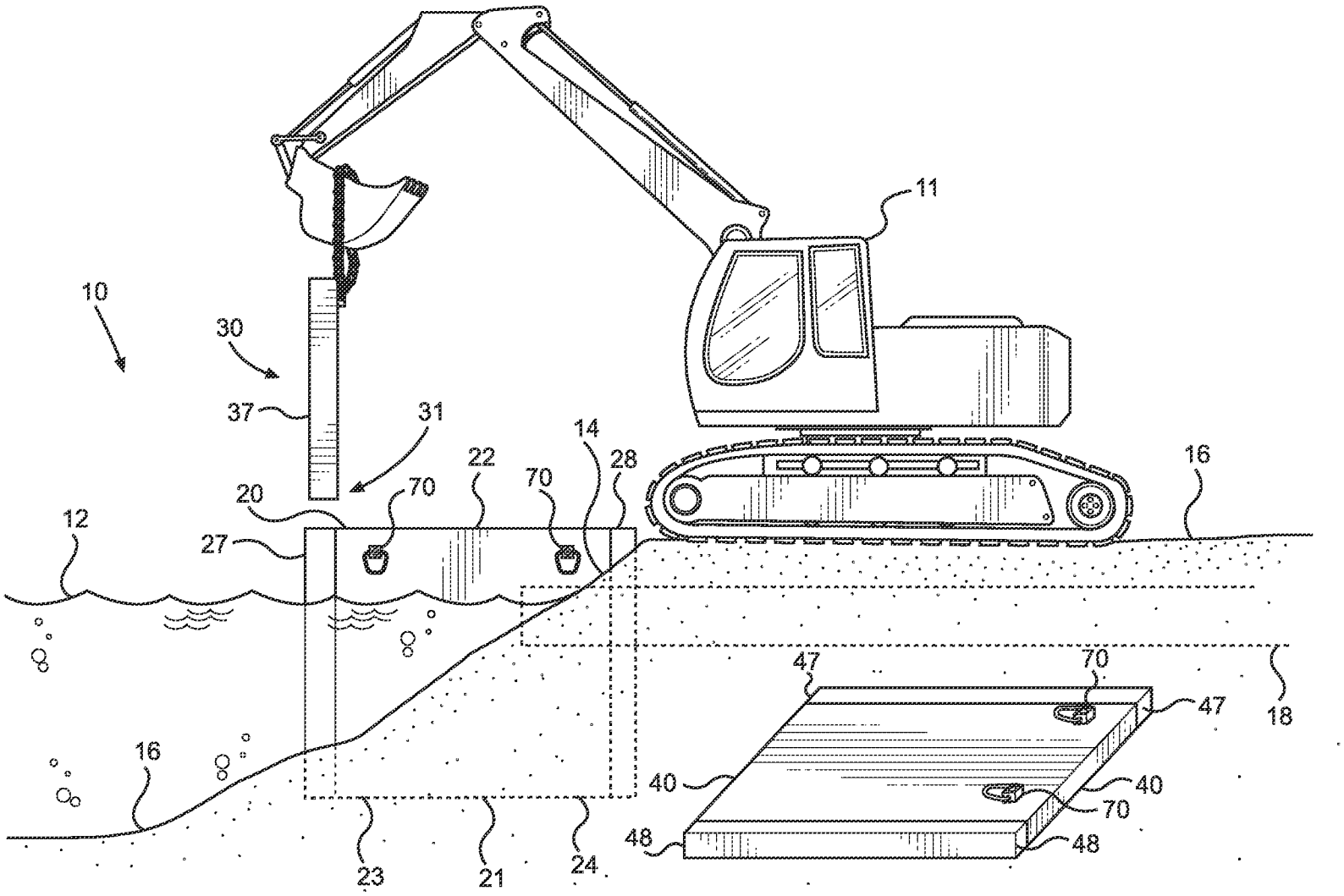
FIG. 1E is a perspective view of positioning the second wall of the example embodiment of the cofferdam.
Figure 1F:
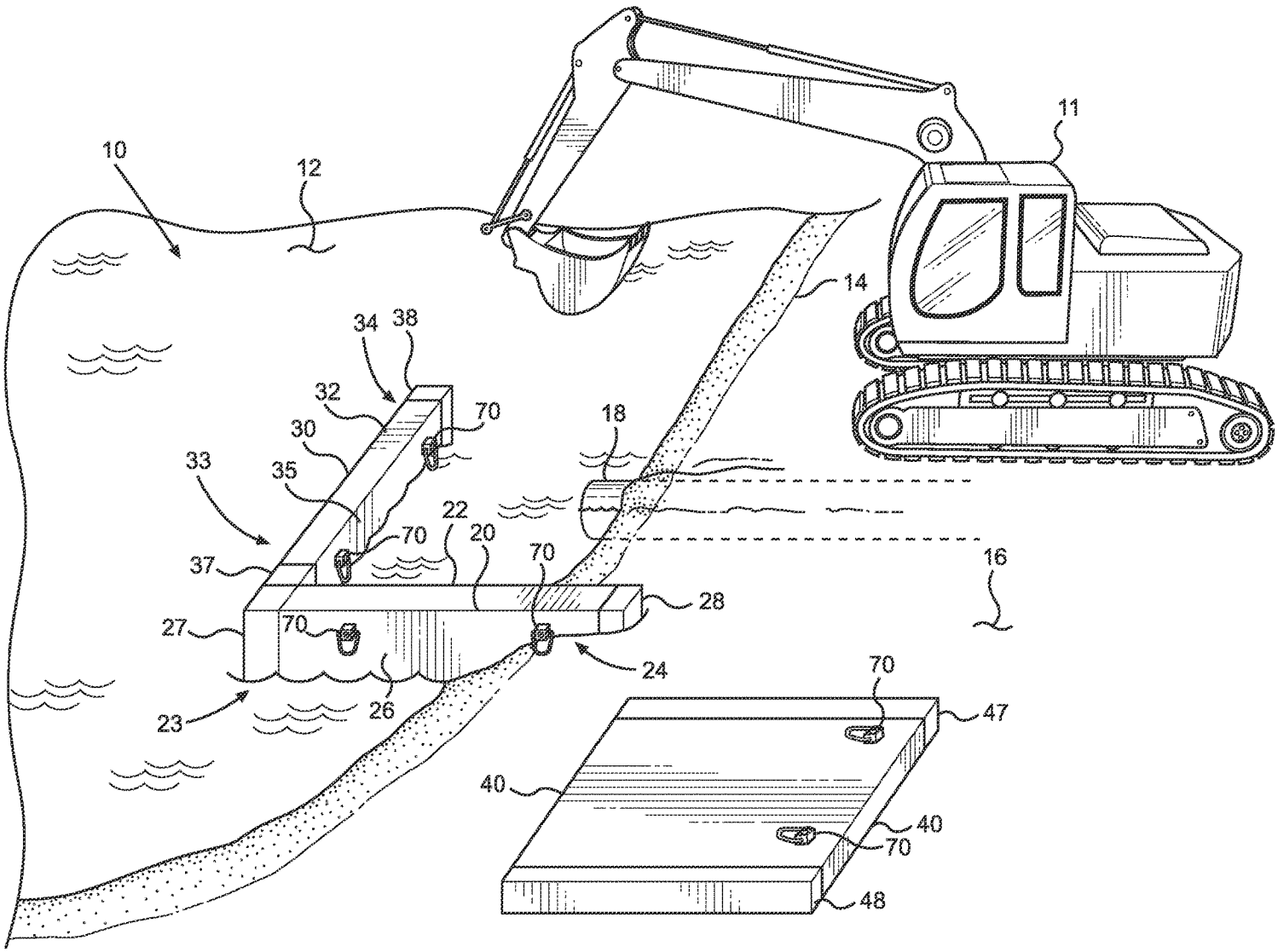
FIG. 1F is a perspective view of the second wall coupled to the first wall of the example embodiment of the cofferdam.
Figure 1G:
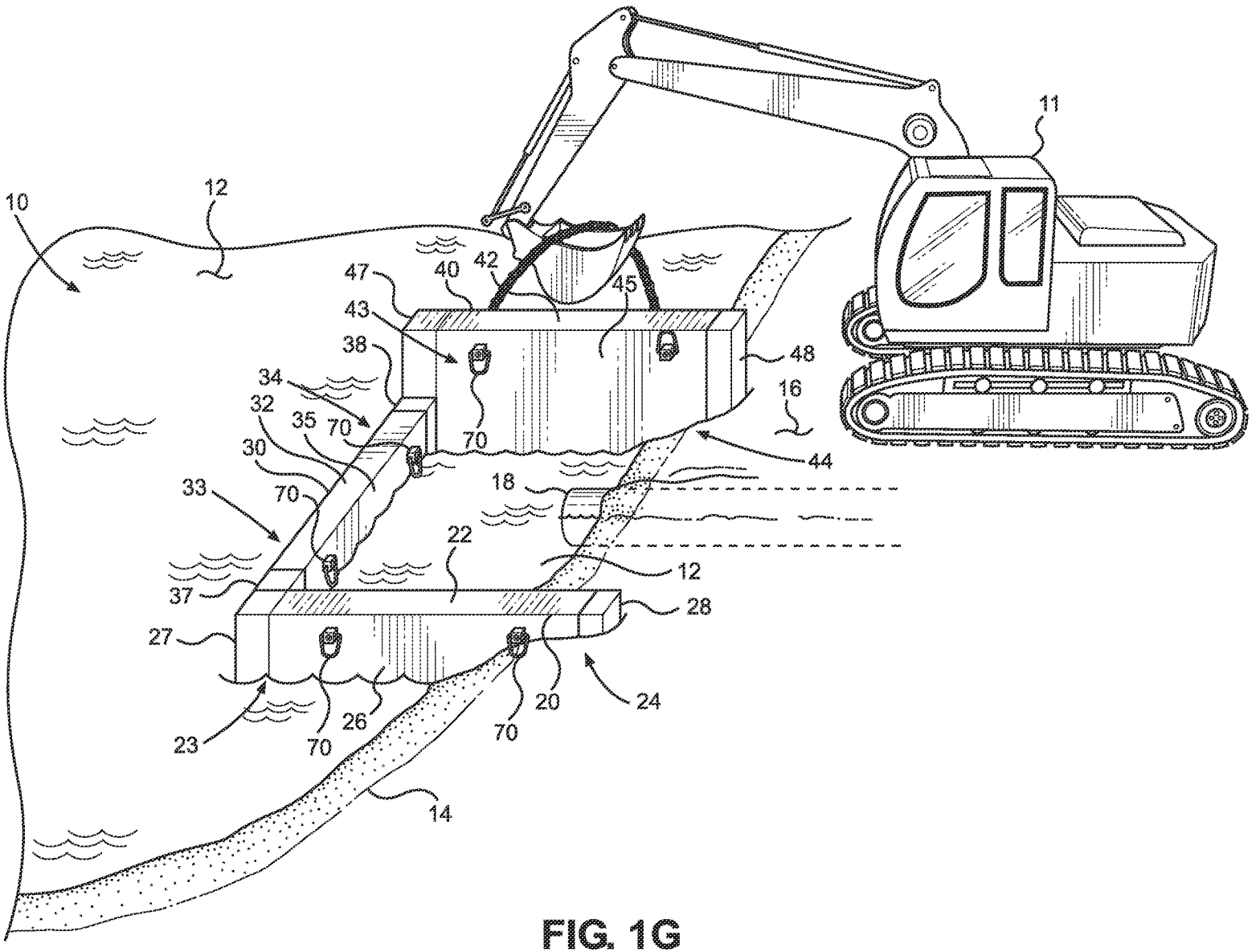
FIG. 1G is a perspective view of the third wall being positioned and coupled to the second wall of the example embodiment of the cofferdam.
Figure 2:
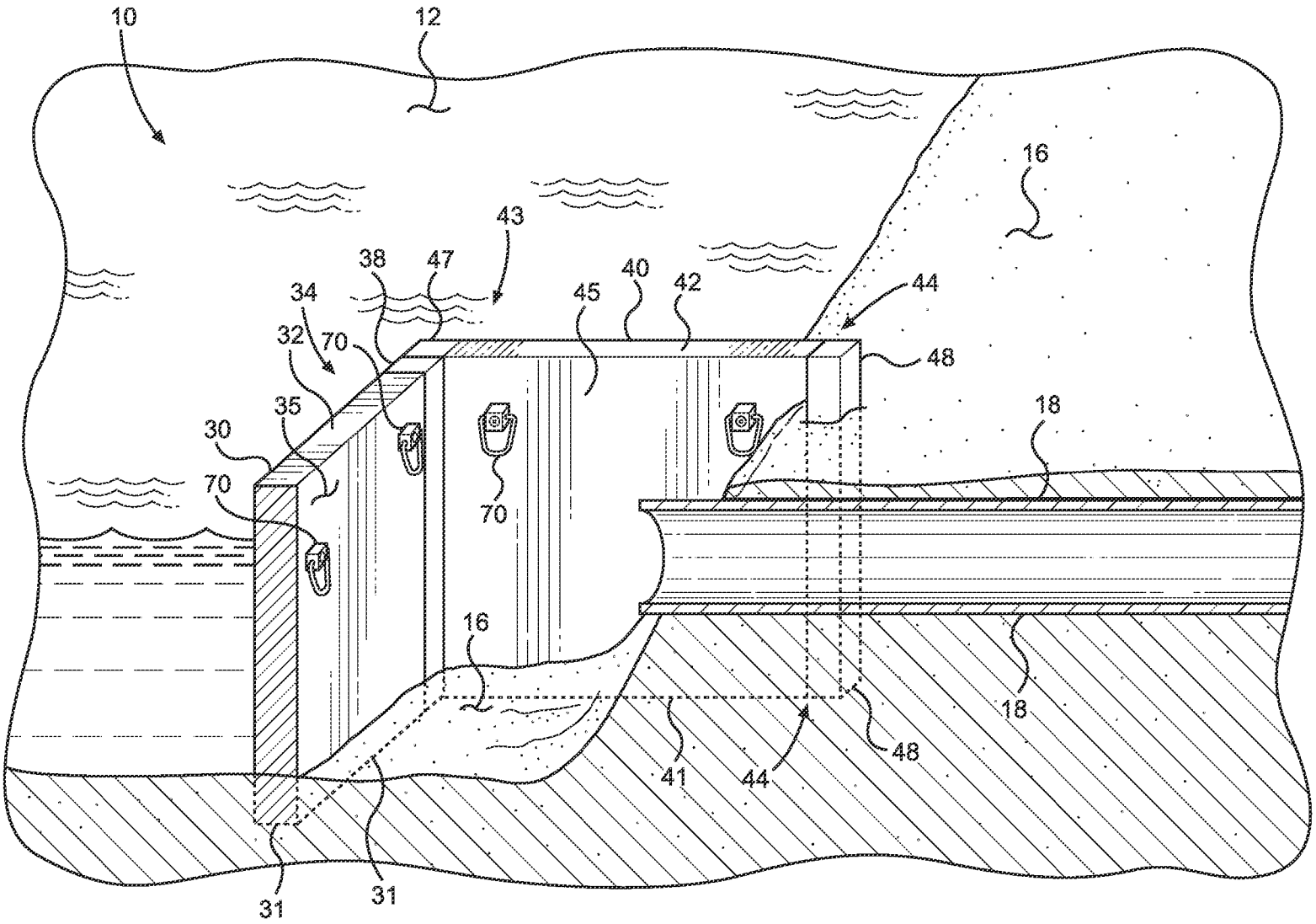
FIG. 2 is a cross-section of the example embodiment of the cofferdam after assembly.
Figure 3:
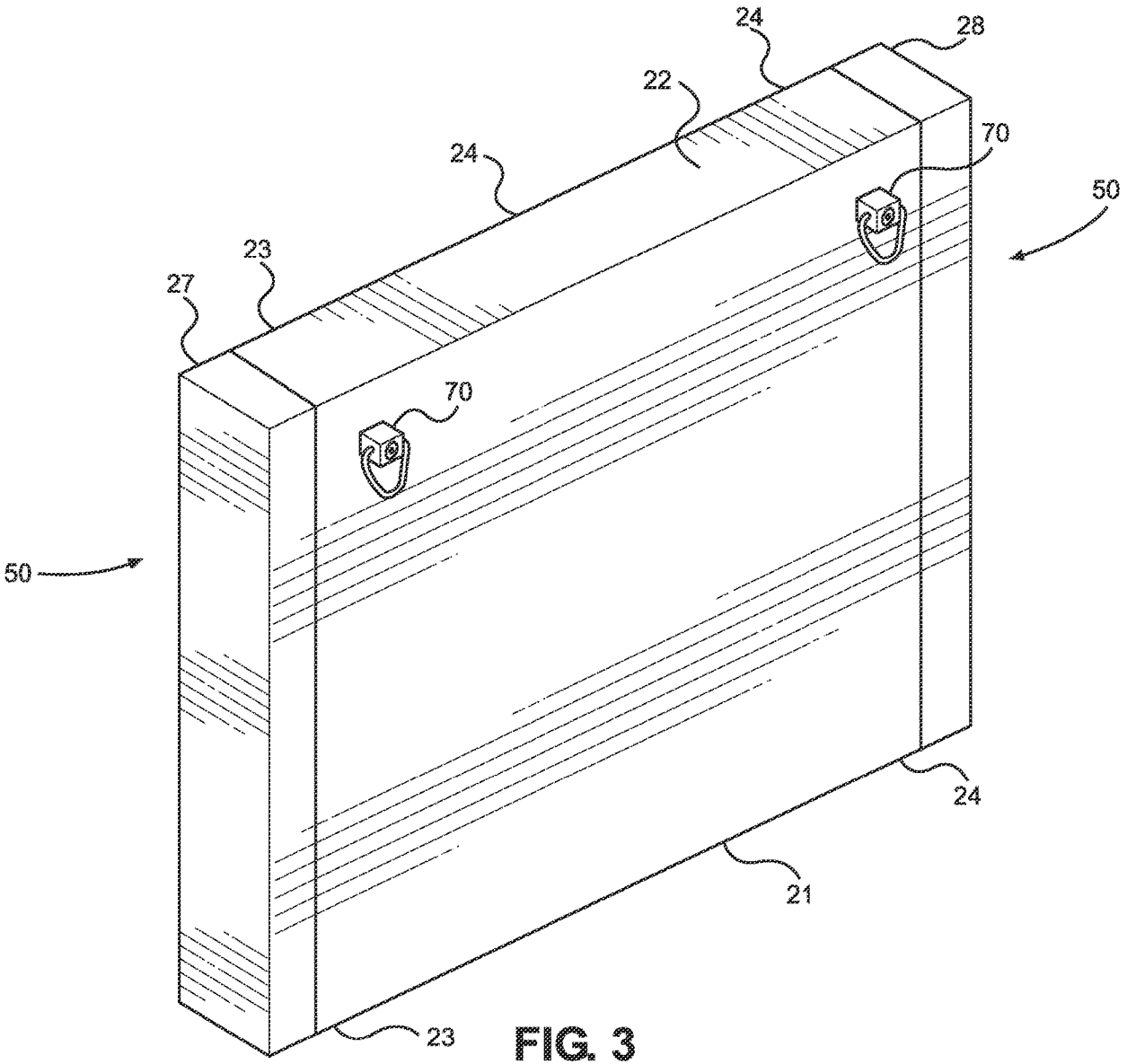
FIG. 3 is a perspective view of an example embodiment of the first wall with generic male couplers.

When disassembled, as best seen in FIG. 1B, the walls 20, 30 and 40 may be stacked on their sides (e.g., flat, laying down) or edges (e.g., lower, upper, vertically) for transport or storage.

C. Male Coupler and Female Coupler: First Example Implementation.

The first couplers 27, 37 and 47, and the second couplers 28, 38 and 48 of the walls 20, 30 and 40 respectively may be implemented as the male coupler 50 or the female coupler 60. For example, the first coupler 27 and the second coupler 28 of the first wall 20 may be the male coupler 50 and the male coupler 50 respectively, or the male coupler 50 and the female coupler 60 respectively, or the female coupler 60 and the female coupler 60 respectively, or the female coupler 60 and the male coupler 50. The same various combinations of the first couplers 37 and 47, and the second couplers 38 and 48 of the walls 30 and 40 applies.

The male coupler 50 is configured to couple to the female coupler 60. The male coupler 50 is not configured to couple to another male coupler 50 and the female coupler 60 is not configured to couple to another female coupler 60. So, if two walls are to be coupled together, one wall must have the male coupler 50 and the other wall must have the female coupler 60. If all of the couplers of both walls are all the male coupler 50 or all the female coupler 60, the two walls cannot be coupled to each other.

In an example embodiment discussed above, the first coupler 27 of the first wall 20 couples to the first coupler 37 of the second wall 30. In this example embodiment, in order for first coupler 27 to couple to the first coupler 37, the first coupler 27 of the first wall 20 is the male coupler 50 and the first coupler 37 of the second wall 30 is the female coupler 60. Or, in another example embodiment, the first coupler 27 of the first wall 20 can couple to the first coupler 37 of the second wall 30 when the first coupler 27 of the first wall 20 is the female coupler 60 and the first coupler 37 of the second wall 30 is the male coupler 50.

The male coupler 50 and the female coupler 60 may be implemented in a variety of ways. As discussed above, the shape of the male coupler 50 complements the shape of the female coupler 60 to enable coupling. In the first example embodiment of the male coupler 50 and the female coupler 60, as best shown in FIGS. 4-15, the male coupler 50 is a round protrusion 52 and the female coupler 60 is a round receiver 62. When viewed from either end (e.g., top, bottom), the round receiver 62 looks like the letter C (e.g., is C-shaped).

Figure 4:
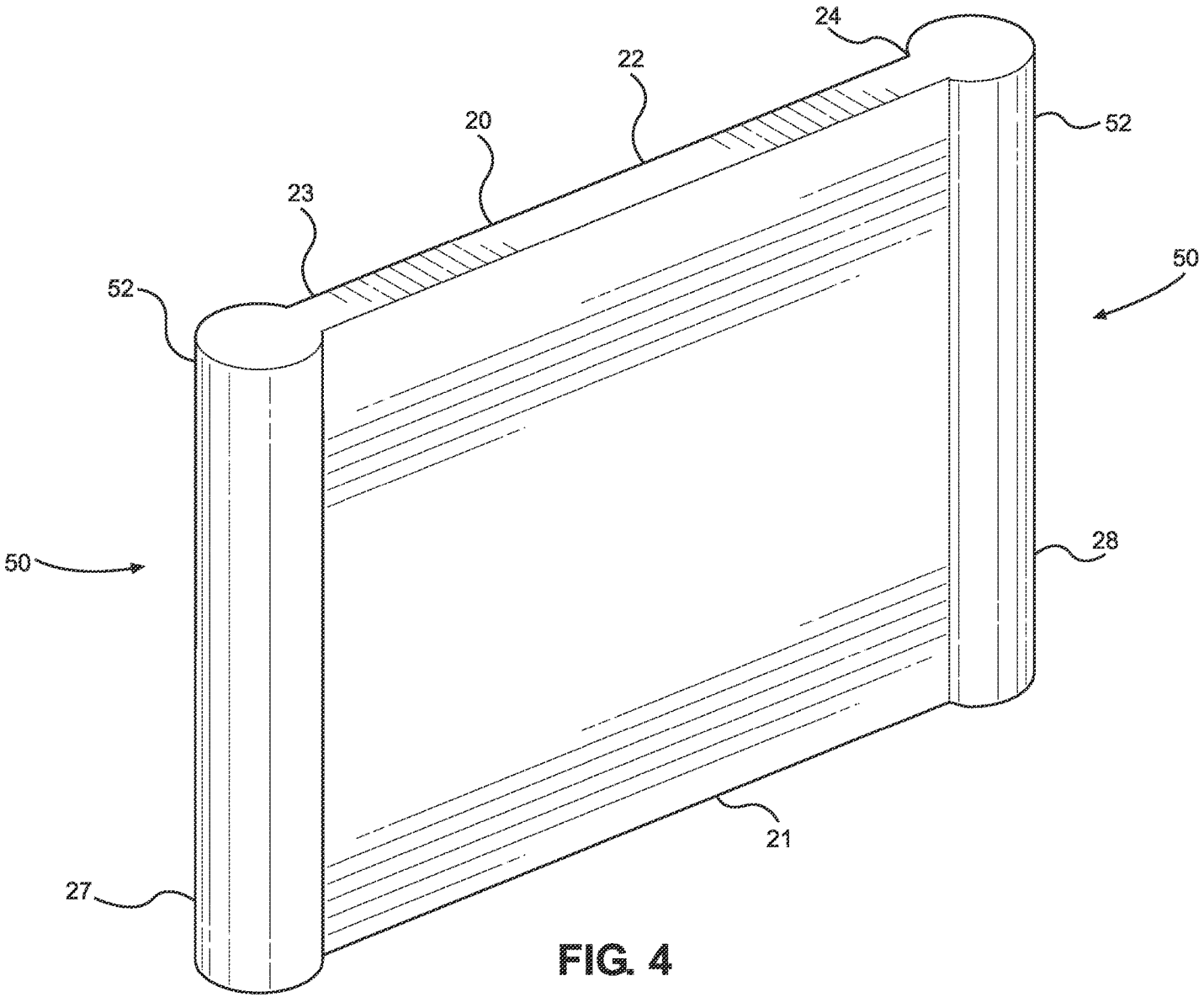
FIG. 4 is a perspective view of the example embodiment of the first wall with a first example embodiment of male couplers.
Figure 5:
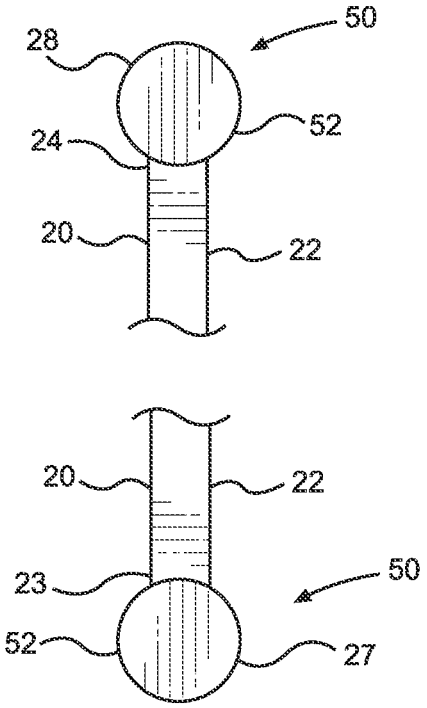
FIG. 5 is a top view of the example embodiment of the first wall with the first example embodiment of male couplers.
Figure 6:
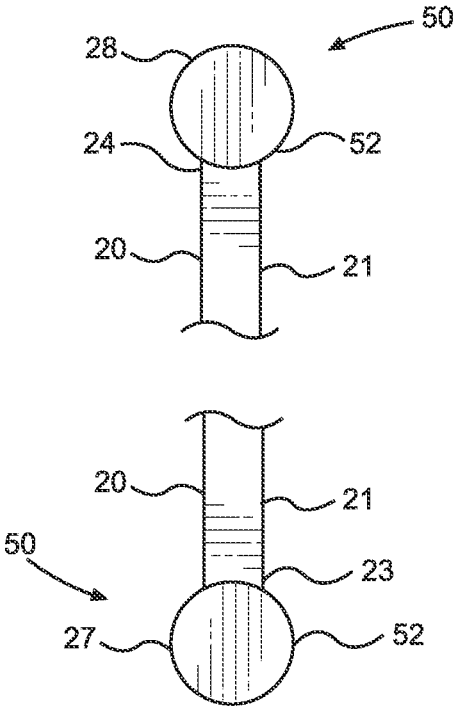
FIG. 6 is a bottom view of the example embodiment of the first wall with the first example embodiment of male couplers.
Figure 7:
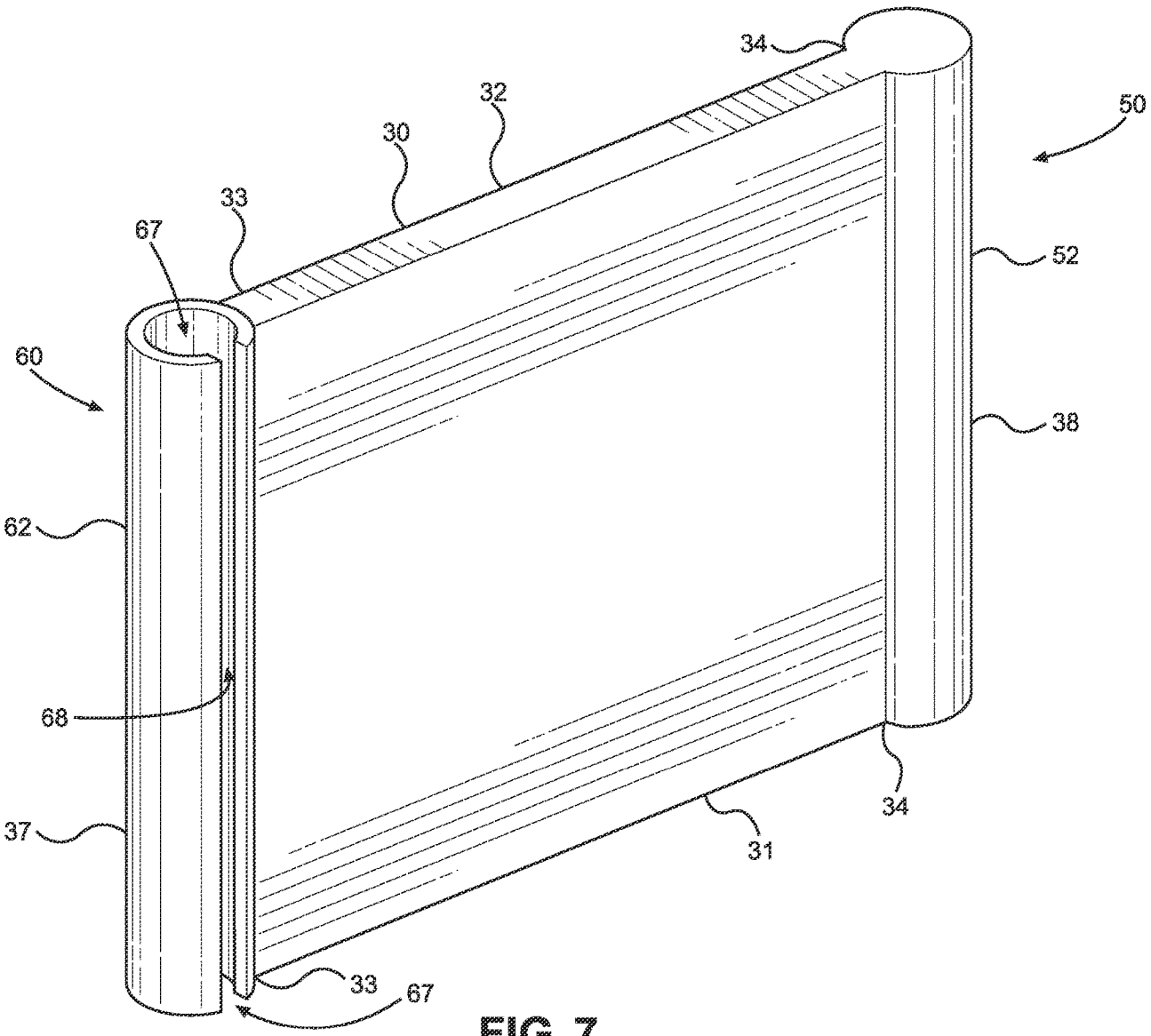
In FIG. 7 is a perspective view of the example embodiment of the second wall with the first example embodiment of the male couplers and a female coupler.
Figure 8:
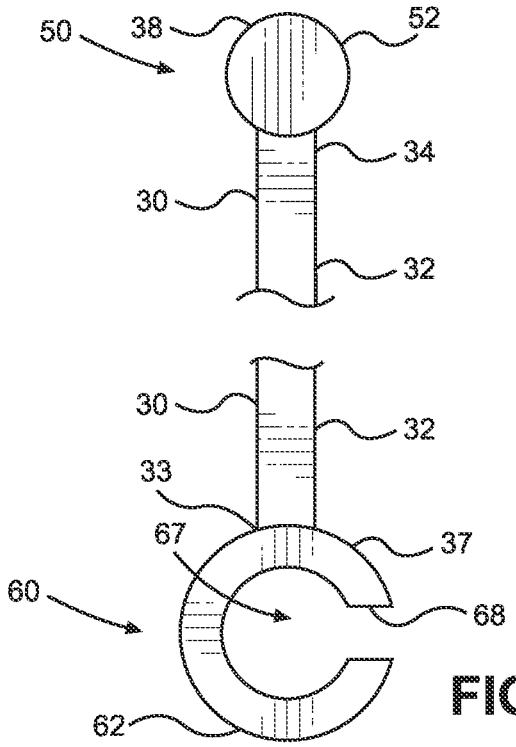
FIG. 8 is a top view of the example embodiment of the second wall with the first example embodiment of the male coupler and the female coupler.
Figure 9:
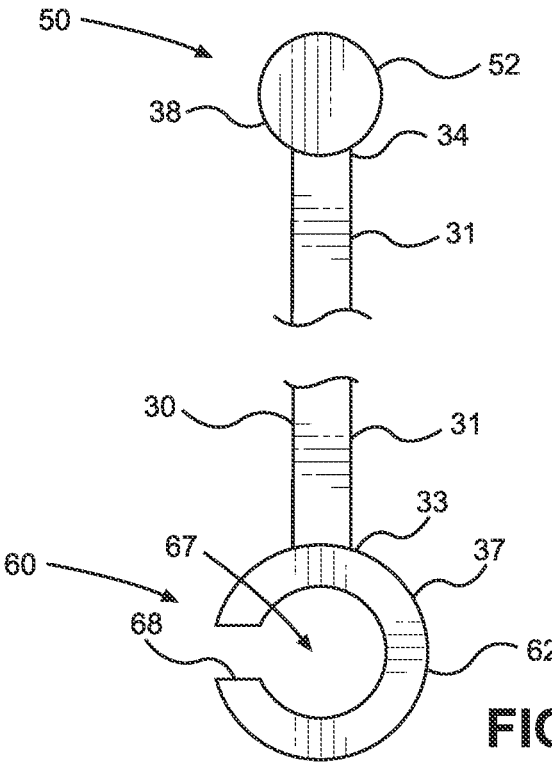
FIG. 9 is a bottom view of the example embodiment of the second wall with the first example embodiment of the male coupler and the female coupler.
Figure 13:
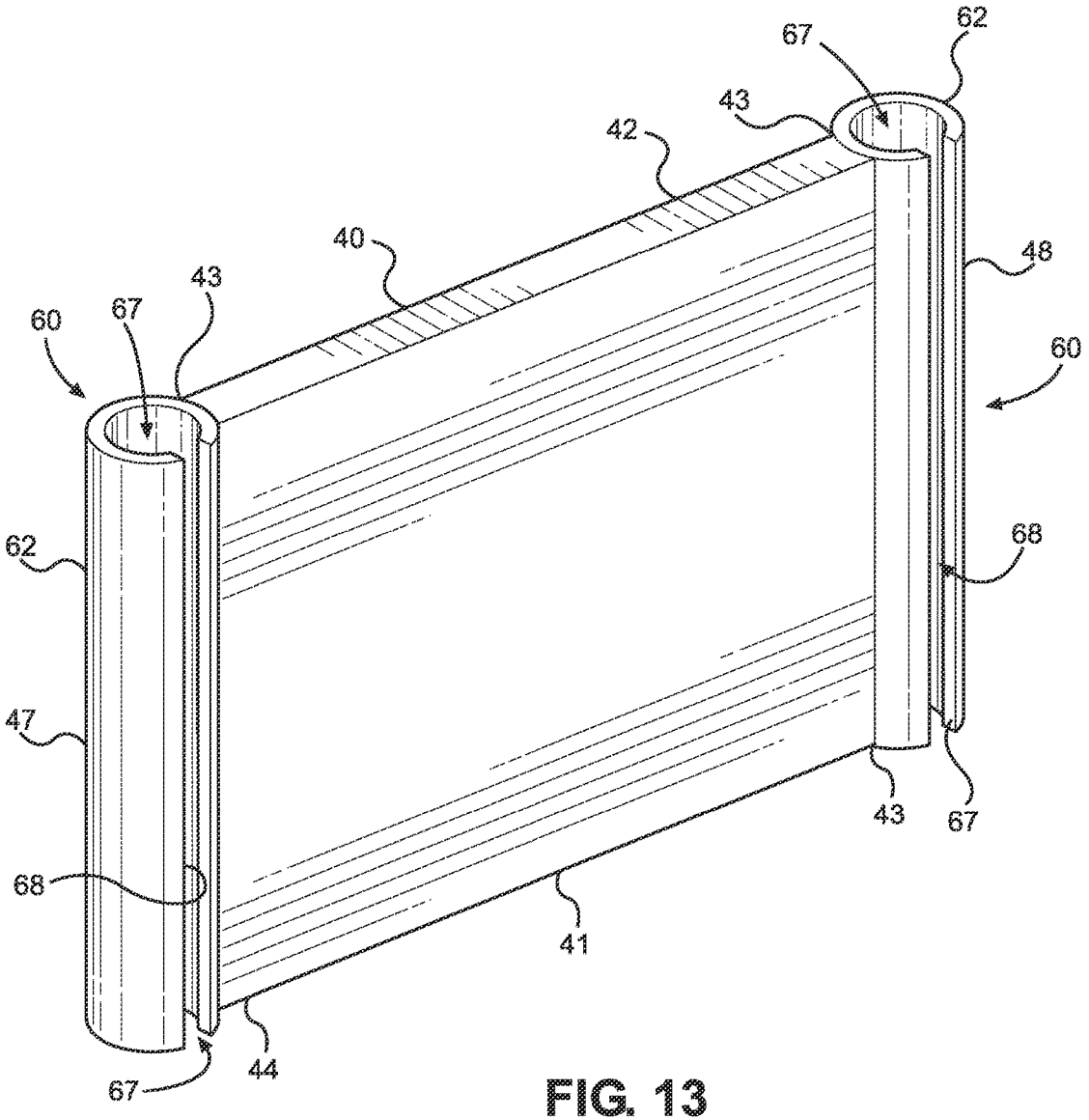
FIG. 13 is a perspective view of an example embodiment of the third wall with the first example embodiment of two female couplers.
Figure 12:
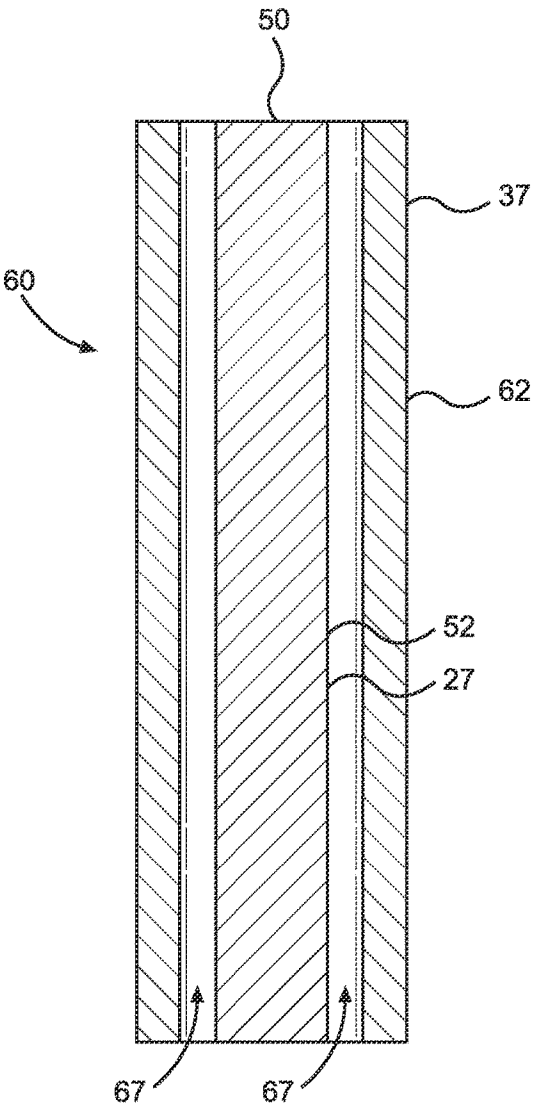
FIG. 12 is a cross-section of the first example embodiment male and female couplers of FIG. 10.

In an example embodiment of walls 20, 30 and 40, as best seen in FIGS. 4, 7 and 13, the first coupler 27 and the second coupler 28 of the first wall 20 are respectively implemented as the round protrusion 52 (e.g., first embodiment of the male coupler 50). The first coupler 37 and the second coupler 38 of the second wall are respectively implemented as the round receiver 62 (e.g., first embodiment of the female coupler 60) and the round protrusion 52. The first coupler 47 and the second coupler 48 of the third wall 40 are respectively implemented as the round receiver 62. The first coupler 27 (e.g., round protrusion 52, male coupler 50) of the first wall 20 couples to the first coupler 37 (e.g., round receiver 62, female coupler 60) of the second wall 30. The second coupler 38 (e.g., round protrusion 52, male coupler 50) of the second wall 30 couples to the first coupler 47 (e.g., round receiver 62, female coupler 60) of the third wall 40.

The round receiver 62 includes a channel 67 therethrough and a slot 68 along its length. The round protrusion 52 is coupled to the round receiver 62 by inserting the round protrusion 52 into the channel 67 of the round receiver 62 and sliding the round protrusion 52 along a length of the channel 67. The wall with the round protrusion 52 extends from the slot 68. Because the width of the slot 68 is less than the outside diameter of the round protrusion 52, the round protrusion 52 cannot exit the channel 67 of the round receiver 62, so the round receiver 62 holds (e.g., couples to) the round protrusion 52.

The round protrusion 52 may be inserted into (e.g., engage) either end (e.g., upper, lower) of the round receiver 62. For example, the lower end of the round protrusion 52 (e.g., end proximate to the lower edge 21) may be inserted into the channel 67 via the upper end of the round receiver 62 (e.g., end proximate to the upper edge 32). The round protrusion 52 may slide along the channel 67 of the round receiver 62 until the lower end of the round protrusion 52 is proximate to the lower end of the round receiver 62, or vice a versa.

With respect to the example implementation, referring to FIGS. 4, 7, 11 and 13, the upper end of the round protrusion 52 on the first end 23 of the first wall 20 is inserted into the channel 67 via the lower end of the round receiver 62 on the first end 33 of the second wall 30. The second wall 30 moves downward so that the round protrusion 52 slides along a length of the channel 67 of the round receiver 62 until the lower end of the round receiver 62 is proximate to the lower end of the round protrusion 52.

The second wall 30 is coupled to the third wall 40 by inserting the upper end of the round protrusion 52 on the second end 24 of the second wall 30 into the channel 67 via the lower end of the round receiver 62 on the first end 43 of the third wall 40. The third wall 40 moves downward so that the round protrusion 52 slides along the length of the channel 67 of the round receiver 62 until the lower end of the round receiver 62 is proximate to the lower end of the round protrusion 52. In this first embodiment of the male coupler 50 and that female coupler 60, there is space between the round protrusion 52 and the inside wall of the channel 67 while they are coupled, so the water 12 can enter the side of the slot 68 on the exterior side of the cofferdam, pass through the channel 67, and exit the side of the slot 68 on the interior side of the cofferdam to enter into the interior of the cofferdam.

However, most of the slot 68 is blocked by the wall (e.g., first wall 20). The wall may contact the sides of the opening of the slot 68 to form a seal that stops some if not all water infiltration into the interior of the cofferdam.

D. Male Coupler and Female Coupler: Second Example Implementation.

Figure 16:
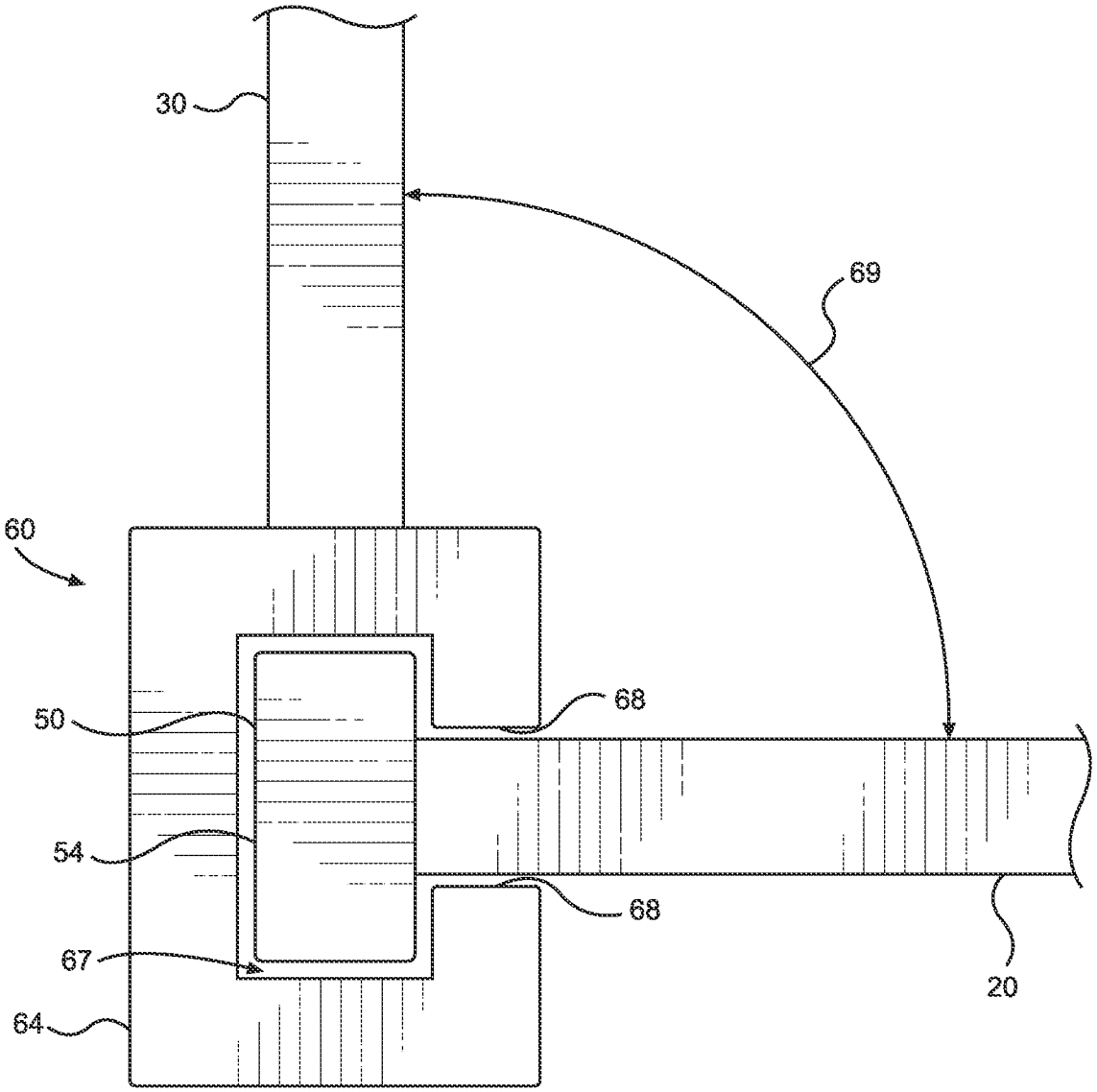
FIG. 16 is a top view of a second example embodiment of the male coupler and the female coupler.

In a second embodiment of the male coupler 50 and the female coupler 60, as best shown in FIG. 16, the male coupler 50 may be implemented as a rectangular protrusion 54 and the female coupler 60 may be implemented as a rectangular receiver 64. When viewed from either end (e.g., top, bottom), the rectangular receiver 64 looks like a squarish letter C (e.g., C-shaped).

The rectangular receiver 64 has a channel 67 and a slot 68 along its length. The rectangular protrusion 54 is coupled to the rectangular receiver 64 by inserting the rectangular protrusion 54 into the channel 67 of the rectangular receiver 64 and sliding the rectangular protrusion 54 along a length the channel 67 of the rectangular receiver 64. The wall (e.g., 20) extends from the slot 68. Because the width of the slot 68 is less than the width of the rectangular protrusion 54, the rectangular protrusion 54 cannot exit the channel 67 of the rectangular receiver 64, so the rectangular receiver 64 holds (e.g., couples to) the rectangular protrusion 54. The rectangular protrusion 54 may be inserted into (e.g., engage) either end (e.g., upper, lower) of the rectangular receiver 64. For example, the lower end of the rectangular protrusion 54 (e.g., end proximate to the lower edge 21) may be inserted into the channel 67 via the upper end of the rectangular receiver 64 (e.g., end proximate to the upper edge 32). The rectangular protrusion 54 may slide along the channel 67 of the rectangular receiver 64 until the lower end of the rectangular protrusion 54 is proximate to the lower end of the rectangular receiver 64, or vice a versa.

The rectangular protrusion 54 provides more area near the opening of the slot 68 of the rectangular receiver 64, so there is a greater likelihood that the rectangular protrusion 54 will better seal against the inside of the channel 67 of the rectangular receiver 64 thereby decreasing the likelihood that water will pass from the exterior of the cofferdam into the interior of the cofferdam via the couplers.

E. Angle Between Walls.

As discussed above, the female coupler 60 (e.g., round receiver 62, rectangular receiver 64) includes the slot 68. While the male coupler 50 (e.g., round protrusion 52, rectangular protrusion 54) is coupled to the female coupler 60, the wall connected to the male coupler 50 (e.g., first wall 20) is positioned in and extends from the slot 68. The position of the slot 68 with respect to the wall to which the female coupler 60 is connected (e.g., second wall 30) determines the angle between the walls (e.g., 20 and 30) when coupled.

Figure 10:
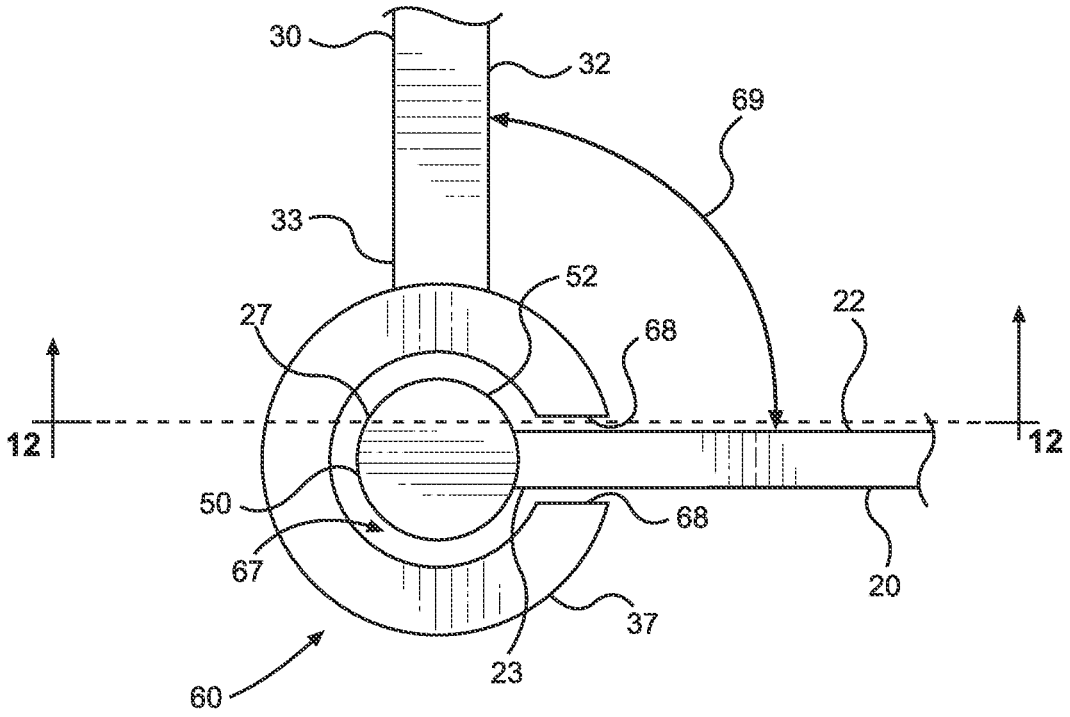
FIG. 10 is a top view of the example embodiment of the first wall coupled to the example embodiment of the second wall using the first example embodiment of the male coupler and the female coupler.
Figure 11:
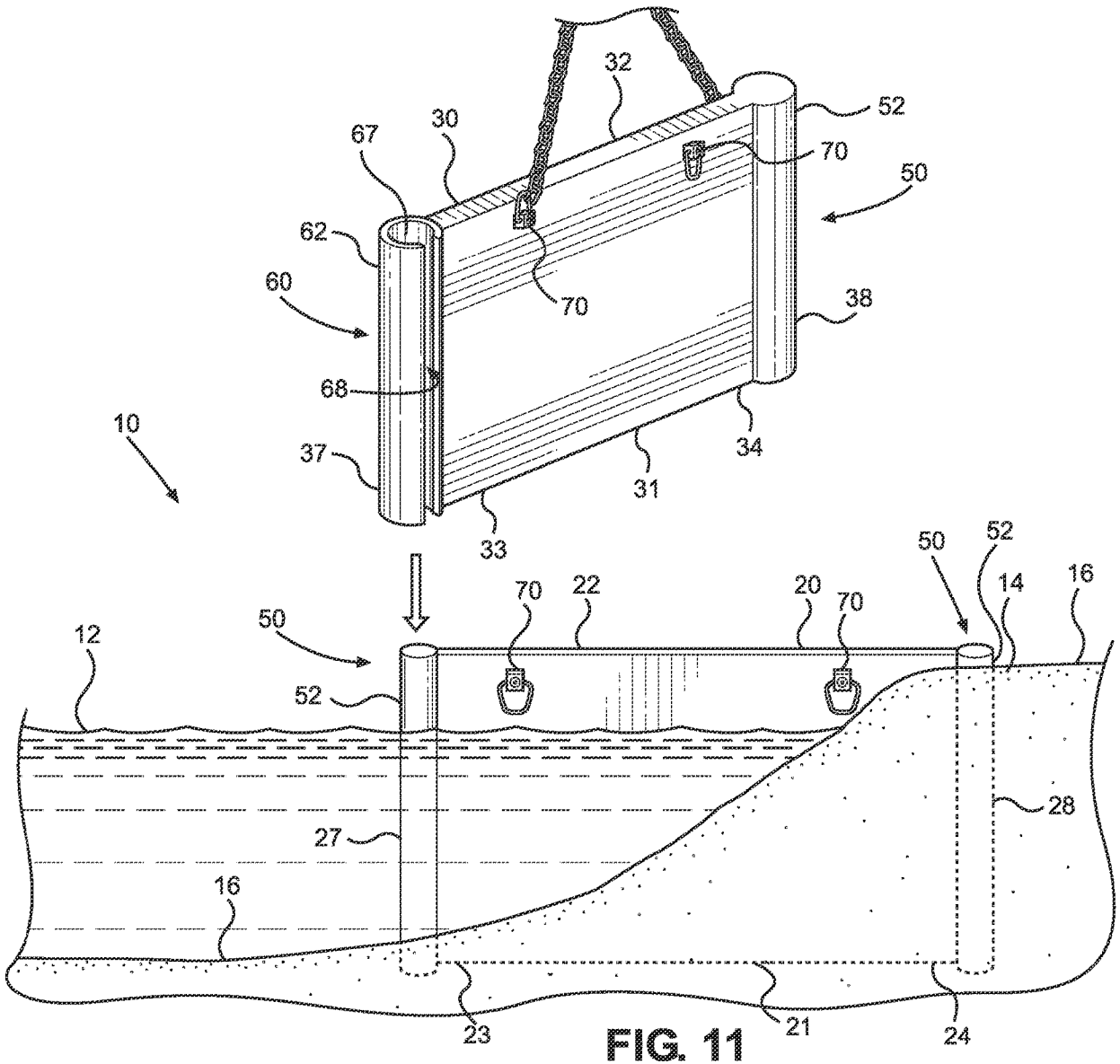
FIG. 11 is a perspective view of aligning the first example embodiment of the female coupler with the first example embodiment of the male coupler for coupling the female coupler to the male coupler.
Figure 14:
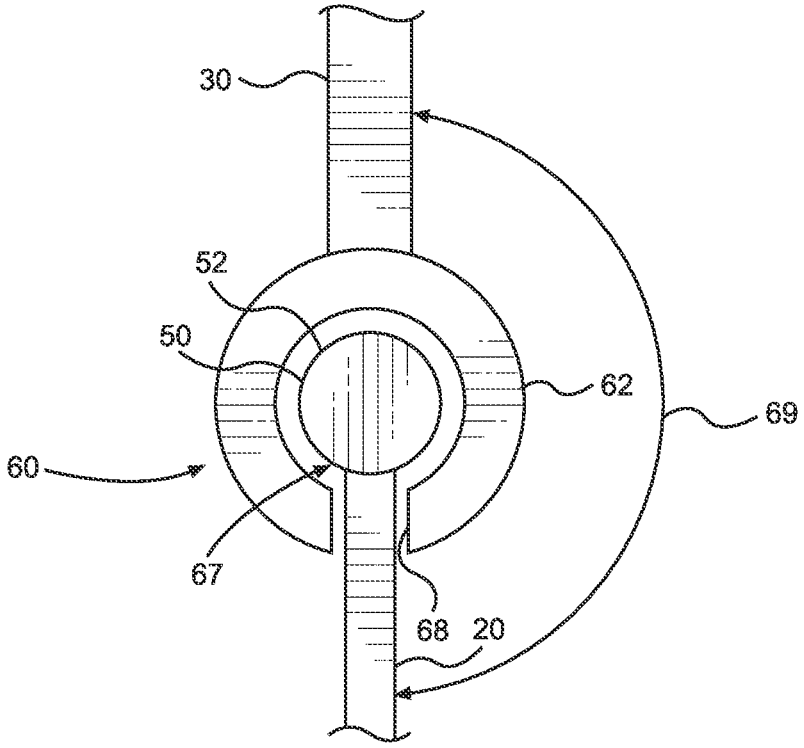
FIG. 14 is a top view of the slot of the first example embodiment of the female coupler with respect to the second wall.
Figure 15:
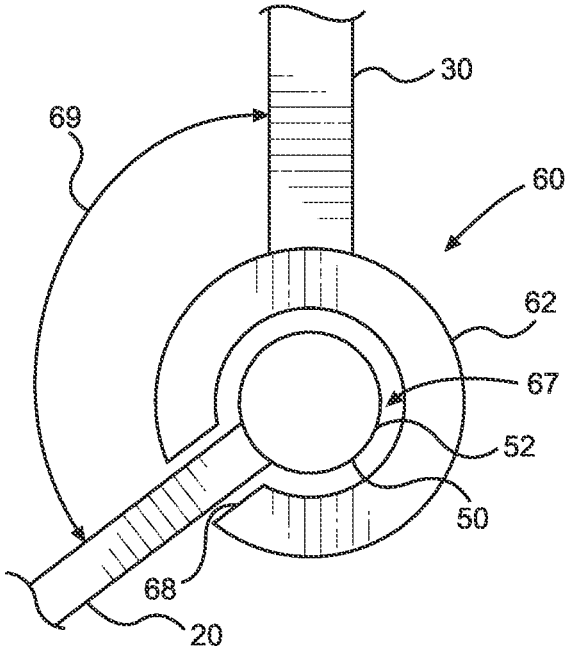
FIG. 15 is a top view of how the slot of the first example embodiment of the female with respect to the second wall.

For example, as best shown in FIGS. 10 and 14-15, the female coupler 60, implemented as round receiver 62, is connected to the first end 33 of the second wall 30. The male coupler 50, implemented as the round protrusion 52, is connected to the first end 23 of the first wall 20. The male coupler 50 is inserted into the female coupler 60. The first wall 20 is positioned in and extends from the slot 68. The slot 68 is positioned an angle 69 with respect to the second wall 30. So, while the first wall 20 is coupled to the second wall 30, the first wall 20 extends from the slot 68 and is also positioned at the angle 69 with respect to the second wall 30.

As shown in FIG. 10, the angle 69 between the slot 68 and the second wall 30 is about 90 degrees, so while the first wall 20 is coupled to the second wall 30, the angle 69 between the first wall 20 and the second wall 30 is also about 90 degrees. The first wall 20 is held in position at the angle 69 by the edges of the slot 68. If the first wall 20 moves outward, the angle 69 between the first wall 20 and the second wall 30 increases until the first wall 20 contacts the edge (e.g., edge toward the bottom of the page) of slot 68. If the first wall 20 moves inward, the angle 69 between the first wall 20 and the second wall 30 decreases until the first wall 20 contacts the edge (e.g., edge toward the top of the page) of the slot 68. As the width of the slot 68 is increased, the angle 69 between the first wall 20 and the second wall 30 may increase and decrease from the nominal value of the angle 69. For example, the middle of the slot 68 may be positioned at 90 degrees to the second wall 30, but the slot 68 may be wide enough so that the second first wall 20 may be positioned at 90 degrees plus or minus 15-20 degrees. However, the width of the slot 68 must be small (e.g., narrow, closed) enough to hold (e.g., trap, not let pass) the round protrusion 52 so that round protrusion 52 and the round receiver 62 remain coupled together. Further, as the width of the slot 68 increases, contact between the edges of the slot 68 and the first wall 20 decreases thereby decreasing the sealing between the edges of the slot 68 and the first wall 20. Decreasing the seal between the edges of the slot 68 and the first wall 20 may permit the water 12 to pass through the channel 67 out the slot 68 and into the interior of the cofferdam. In FIG. 14, the angle 69 between the slot 68 and the second wall 30 is about 180 degrees, so while the first wall 20 is coupled to the second wall 30, the angle 69 between the first wall 20 and the second wall 30 is also about 180 degrees. In FIG. 15, the angle 69 between the slot 68 and the second wall 30 is about 135 degrees (225 degrees in the clockwise direction), so while the first wall 20 is coupled to the second wall 30, the angle 69 between the first wall 20 and the second wall 30 is also about 135 degrees.

The same concept applies when the male coupler 50 and female coupler 60 are implemented as the rectangular protrusion 54 and the rectangular receiver 64. As shown in FIG. 16, the angle between the second wall 30 and the slot 68 is about 90 degrees, so while the first wall 20 is coupled to the second wall 30, the first wall 20 is positioned at about 90 degrees with respect to the second wall 30.

The angle 69 determines the shape of the cofferdam once all of the walls have been coupled. For example, in the example embodiment of the walls 20, 30 and 40, the angle 69 between the interior sides 25 and 35, and the interior sides 25 and 45 respectively is about 90 degrees. Referring to FIG. 1A, as the angle 69 between the walls 20, 30 and 40 increases (e.g., greater than 90 degrees) the U-shape becomes more shallow and provides less distance between the inlet of the culvert 18 and the second wall 30. As angle 69 decreases, the second ends 24 and 44 get closer to the sides of the culvert 18 and may interfere with the work being performed.

Cofferdams may be assembled from walls that have a variety of angles between the slot 68 and the wall. Walls may be selected with an appropriate angle between the wall and the slot 68 to assemble a cofferdam of any shape or size.

F. Connectors.

A cofferdam may be assembled using a combination of walls and connectors. In an example embodiment, as best shown in FIGS. 18-21, connectors are positioned between walls to connect the adjacent walls to each other. A first connector 80 and a second connector 90 each include four couplers (e.g., 82, 84, 86, 88 and 92, 94, 96, 98). The couplers of the first connector 80 and the second connector 90 may be the male coupler 50 or the female coupler 60. In another example embodiment, the third connector 100 includes eight female couplers 60. The couplers of the first connector 80, the second connector 90 and the third connector 100 are positioned around the connector to connect to walls (e.g., 20, 30, 40) at various angles 69.

In an example embodiment, couplers are formed of a monolithic piece of material that is impervious to water. The couplers of connected to the connectors may be formed separately from the connector and connected to the connector or the couplers of a connector may be integral to the connector. In an example embodiment, the connectors 80, 90 and 100 are formed of a steel pipe having a 12" diameter with the couplers welded along the length thereof.

Figure 18:
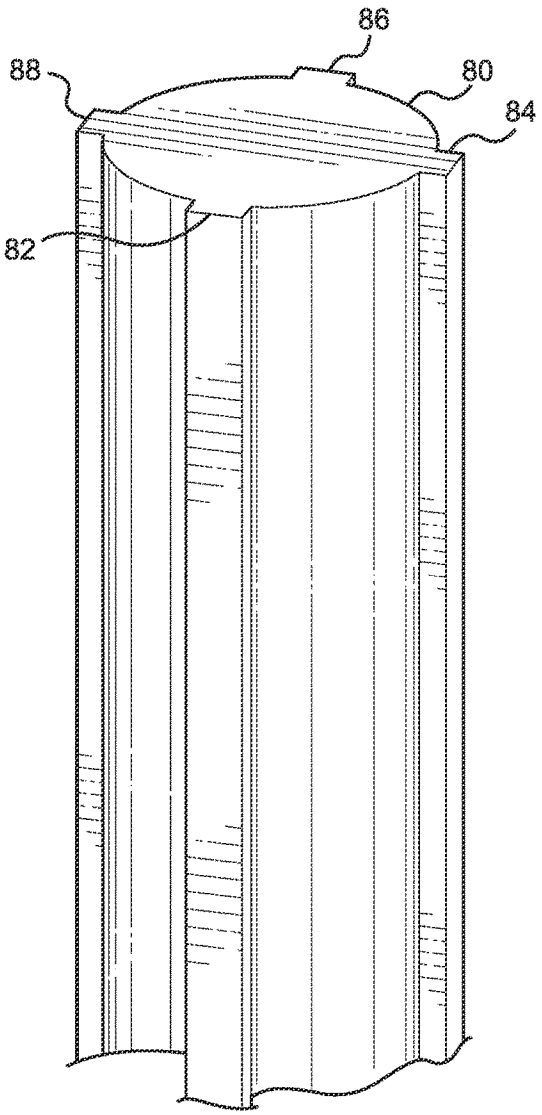
FIG. 18 is a perspective view of a first example embodiment of a connector.

The first connector 80 includes the first coupler 82, the second coupler 84, the third coupler 86 and the fourth coupler 88. The second connector 90 includes the first coupler 92, the second coupler 94, the third coupler 96 and the fourth coupler 98. In another example embodiment, the first connector 80 includes only the first coupler 82, the second coupler 84 and the third coupler 86, and the second connector 90 includes only the first coupler 92, the second coupler 94 and the third coupler 96. In FIGS. 18 and 20-20, the couplers (e.g., 82, 84, 86, 88, 92, 94, 96, 98) of the first connector 80 and the second connector 90 are shown as generic couplers which can be either male coupler 50 or female coupler 60.

The first connector 80 and the second connector 90 may be used with the first wall 20, the second wall 30 and the third wall 40 to form a cofferdam. As best seen in FIG. 20, the first coupler 27 of the first wall 20 connects to the first coupler 82 of the first connector 80. The first coupler 37 of the second wall 30 couples to the second coupler of the first connector 80. The second coupler 38 of the second wall 30 couples to the fourth coupler 98 of the second connector 90. The first coupler 47 of the third wall 40 couples to the first coupler 92 of the second connector 90. As assembled, the cofferdam has a U-shaped with the second end 24 of the first wall 20 positioned on one side of the culvert 18 and the second end 44 of the third wall 40 positioned on the other side of the culvert 18.

The third connector 100 includes first coupler 101, the second coupler 102, the third coupler 103, the fourth coupler 104, the fifth coupler 105, the sixth coupler 106, the seventh coupler 107, and the eighth coupler 108. All of the couplers of the third connector 100 are the female couplers 60 which are shown as being implemented as the round receiver 62 in FIG. 19. The couplers of the third connectors 100 shown in FIG. 21 are also all the female coupler 60 and implemented as the round receiver 62; however, they are shown as small blocks due to the scale of the drawing. Further, the first walls 20 shown in FIG. 21 have the male coupler 50 on each end (e.g., first end 23, second end 24) which are implemented as round protrusion 52, so the first walls 20 and the third connectors 100 can coupler each other as shown in FIG. 21.

Figure 19:
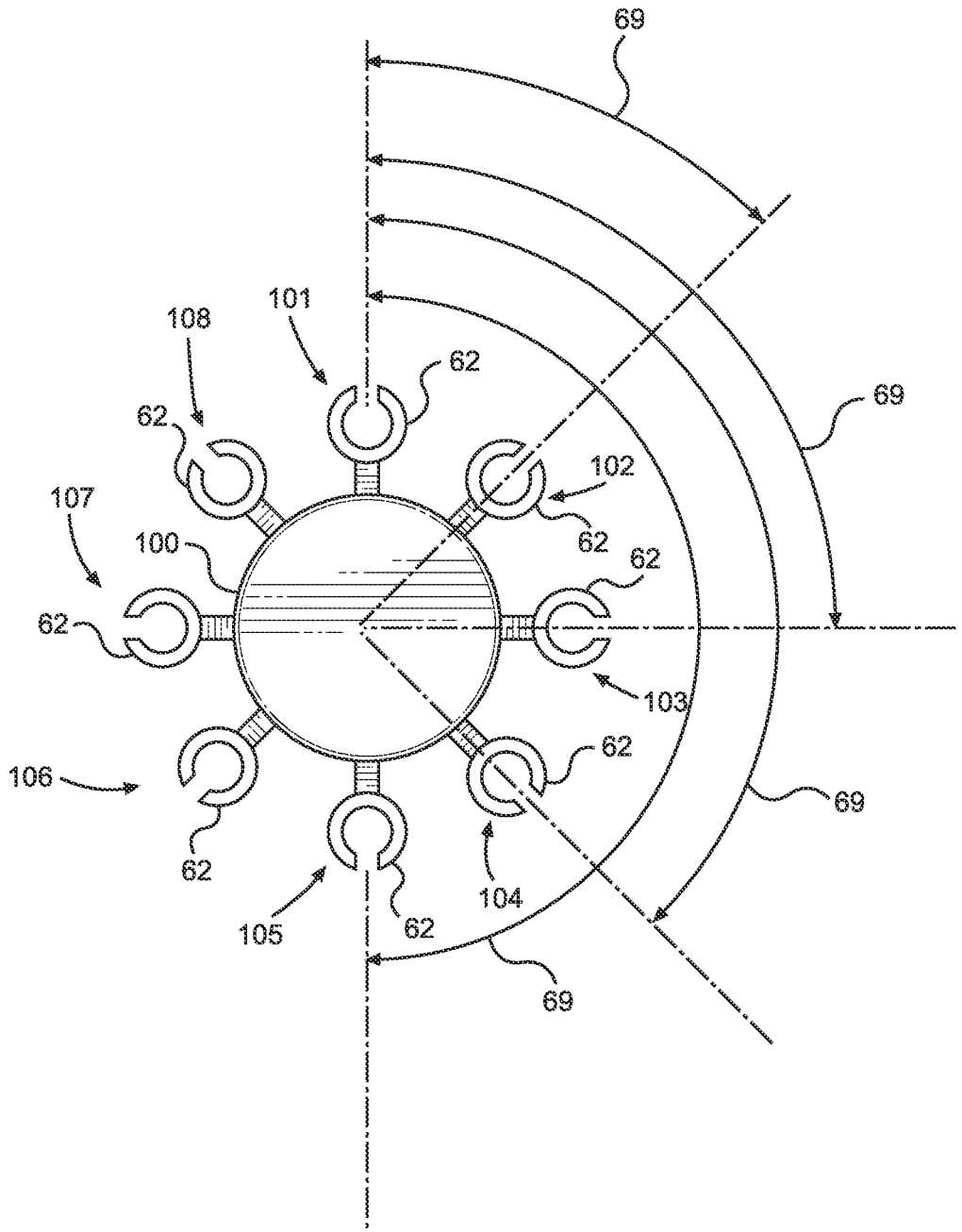
FIG. 19 is a top view of a second example embodiment of a connector.

The round receivers 62 of the third connector 100 also includes the slot 68, which establishes the angle 69 between the third connector 100 and the first wall 20 coupled thereto. The angle 69 established by the slot 68 of the various round receivers 62 is with reference to a central axis of the third connector 100. Referring to FIG. 19, the angle 69 is measured from the first coupler 101. The angle 69 between the first coupler 101 and the second coupler 102, the third coupler 103, the fourth coupler 104 and the fifth coupler 105 is 45 degrees, 90 degrees, 135 degrees, 180 degrees respectively in a clockwise direction. The angle 69 between the first coupler 101 and the eighth coupler 108, the seventh coupler 107 and the sixth coupler 106 is 45 degrees, 90 degrees and 135 degrees respectively in a counterclockwise direction or 315 degrees, 270 degrees and 225 degrees respectively in the clockwise direction.

In an example embodiment, the first coupler 27 and the second coupler 28 of the first wall 20 are implemented as the round protrusion 52. Since all of the couplers of the third connector 100 are implemented as the round receiver 62, either end (e.g., first and 22, second end 24) of the first wall 20 may couple to any of the couplers of the third connector 100. Connecting the first wall 20 to a coupler of the third connector 100 establishes the orientation (e.g., direction) of the first wall 20 with respect to the third connector 100.

In an example embodiment of the cofferdam, best shown in FIG. 20, a plurality of the first wall 20 and a plurality of the third connector 100 are assembled to form the cofferdam. The cofferdam is formed by coupling the first walls 20 to the third connectors 100. Assembly of the cofferdam begins with positioning the first, first wall 20 on the left side of the culverts 18. The fifth coupler 105 of the third connector 100 is coupled to the first coupler 27 of the present first wall 20.

The first coupler 101 of the present third connector 100 is coupled to the first coupler 27 of the next first wall 20. The second coupler 28 of the present first wall 20 is connected to the fifth coupler 105 of the next third connector 100. The second coupler 102 of the present third connector 100 is coupled to the first coupler 27 of the next first wall 20. The second coupler 28 of the present first wall 20 is coupled to the sixth coupler 106 of the next third connector 100. The third coupler 103 of the present third connector 100 is coupled to the first coupler 27 of the next first wall 20. The second coupler 28 of the present first wall 20 is coupled to the seventh coupler 107 of the next third connector 100. The fourth coupler 104 of the present third connector 100 is coupled to the first coupler 27 of the next first wall 20. The second coupler 28 of the present first wall 20 is coupled to the eighth coupler 108 of the next third connector 100. The fifth coupler 105 of the present third connector 100 is coupled to the first coupler 27 of the next first wall 20. The second coupler 28 of the present first wall 20 is coupled to the first coupler 101 of the next third connector 100. The fifth coupler 105 of the present third connector 100 is coupled to the first coupler 27 of the last first wall 20.

The method of assembling the cofferdam of the example embodiment shown in FIG. 21 assembles a plurality of the first walls 20 and a plurality of the third connectors 100 to form a U-shape. The first wall positioned is on one side of the culverts 18 and the last wall positioned is on the other side of the culverts 18. The couplers (e.g., 27, 28) of the first walls 20 may be coupled to any of the couplers (101-108) of the connector 100 to assemble a cofferdam of any shape and/or size. The cofferdam may be assembled using any number of first walls 20 and any number of the third connectors 100.

G. Hoist Coupler.

A hoist coupler 70 be connected to a wall 20, 30 or 40. One or more hoist couplers 70 may couple to the wall 20, 30 or 40 at any location on the wall 20, 30 or 40. The hoist coupler 70 may be used to hoist (e.g., lift, raise) the wall 20, 30 or 40. The hoist coupler 70 facilitates coupling hoisting gear (e.g., rope, chain, cable) from a piece of construction equipment, for example the excavator 11, to the wall 20, 30 or 40. The excavator 11 may use the hoisting gear while coupled to the walls 20, 30 or 40 to lift the walls from the ground into the air, to position the walls relative to the culvert 18, to position one wall relative to another wall, to position walls relative to a connector (e.g., 80, 90, 100), and to lower the walls to couple the walls to each other or to a connector.

In an example embodiment, the hoist coupler 70 comprises a hole in the wall 20, 30 or 40 through which the hoisting gear may be passed to maneuver the wall. In another example implementation, the hoist coupler 70 comprises a hoist ring, and eyebolt, a tiedown ring, a hook, a cleavers hook and/or a rope guide.

H. Assembling a Cofferdam Using Three Walls.

In the example embodiment introduced above, the cofferdam is formed of the first wall 20, the second wall 30 and the third wall 40. The walls 20, 30 and 40 are hauled to the site of the culvert 18 while disassembled. The cofferdam is assembled to surround the culvert 18, as best shown in FIGS. 1A-1G, by positioning the first wall 20 vertically and near a first side of the inlet of the culvert 18. The first wall 20 includes the first coupler 27 near the first end 23 of the first wall 20. The first wall 20 may be positioned in any manner. In an implementation, positioning the first wall 20 comprises lifting the first wall 20 using a piece of construction equipment such as the excavator 11. The excavator 11 uses hoisting gear attached to the first wall 20 to lift and position the first wall 20 with respect to the culvert 18. When the first wall 20 is in position, the excavator 11 applies a downward force to the upper edge 22 of the first wall 20 to press the first wall 20 downward. Pressing downward on the first wall 20 drives the lower edge 21 of the first wall 20 into the ground surface 16.

The excavator 11 lifts the second wall 30 to position the second wall 30 vertically and above the first wall 20. The second wall 30 includes the first coupler 37 near the first end 33 of the second wall 30 and a second coupler 38 near the second end 34 of the second wall 30. Positioning the second wall 30 positions the first coupler 37 of the second wall 30 so that it is aligned with the first coupler 27 of the first wall 20. The excavator 11 lowers the second wall 30 to slidably couple the first coupler 37 of the second wall 30 with the first coupler 27 of the first wall 20. The excavator 11 applies a downward force to the upper edge 32 of the second wall 30 to press the second wall 30 downward. Pressing downward on the second wall 30 drives the lower edge 31 of the second wall 30 into the ground surface 16.

The excavator 11 lifts the third wall 40 to position the third wall 40 vertically and above the second wall 30. The third wall 40 includes the first coupler 47 near the first end 43 of the third wall 40. Positioning the third wall 40 positions the first coupler 47 of the third wall 40 so that it is aligned with the second coupler 38 of the second wall 30. The excavator 11 lowers the third wall 40 to slidably couple the first coupler 47 of the third wall 40 with the second coupler 38 of the second wall 30. The excavator 11 applies a downward force to the upper edge 42 of the third wall 40 to press the third wall 40 downward. Pressing downward on the third wall 40 drives the lower edge 41 of the third wall 40 into the ground surface 16 and completes the assembly of the cofferdam thereby forming an enclosure around the inlet of the culvert 18 that prevents passage of the water 12 from a body of water 10 into an interior of the enclosure.

The water 12 that is in the interior of the cofferdam may be pumped out to expose the ground surface 16 inside the cofferdam. The cofferdam keeps the water 12 of the body of water 10 outside of the interior of the cofferdam thereby providing a dry work area inside the cofferdam around the inlet of the culvert 18.

As the excavator 11 lowers the second wall 30 to slidably couple the first coupler 37 of the second wall 30 with the first coupler 27 of the first wall 20, the first coupler 37 of the second wall 30 engages with the first coupler 27 of the first wall 20. After the first coupler 37 engages with the first coupler 27, the excavator 11 continues to lower the second wall 30 so that the first coupler 37 of the second wall 30 slides along a length of the first coupler 27 of the first wall 20 thereby coupling the first coupler 37 to the first coupler 27 and the second wall 30 to the first wall 20.

In an example embodiment, the first coupler 27 of the first wall 20 is implemented as the round protrusion 52 (e.g., male coupler 50) and the first coupler 37 of the second wall 30 is implemented as the round receiver 62 (e.g., female coupler 60). The first coupler 37 engages the first coupler 27 when the round protrusion 52 enters the channel 67 of the round receiver 62. The round protrusion 52 slides along the channel 67 the round receiver 62 as the lower edge 31 of the second wall 30 descends toward the ground surface 16.

As the excavator 11 lowers the third wall 40 to slidably couple the first coupler 47 of the third wall 40 with the second coupler 38 of the second wall 30, first coupler 47 of the third wall 40 engages with the second coupler 38 of the second wall 30. After the first coupler 47 engages with the second coupler 38, the excavator 11 continues to lower the third wall 40 so that the first coupler 47 of the third wall 40 slides along a length of the second coupler 38 of the second wall 30 thereby coupling the first coupler 47 to the second coupler 38 and the third wall 40 to the second wall 30.

In an example embodiment, the second coupler 38 is implemented as the round protrusion 52 (e.g., male coupler 50) and the first coupler 47 is implemented as the round receiver 62 (e.g., female coupler 60). The first coupler 47 engages the second coupler 38 when the round protrusion 52 enters the channel 67 of the round receiver 62. The round protrusion 52 slides along the channel 67 the round receiver 62 as the lower edge 41 of the third wall 40 descends toward the ground surface 16.

Slidably coupling the first coupler 27 of the first wall 20 to the first coupler 37 of the second wall 30 forms a seal along a length of the first coupler 27 of the first wall 20 and along a length of the first coupler 37 of the second wall 30 that prevents passage of the water 12 from the body of water 10 into the interior of the enclosure. As discussed above, the seal between the first coupler 27 and the first coupler 37 may not stop the passage of all of the water 12 into the interior of the cofferdam, but it stops most of the water so that the ground surface 16 in the interior of the cofferdam may dry out.

I. Assembling a Cofferdam Using a Plurality of Walls.

A cofferdam may be assembled using a plurality of walls (e.g., 20, 30, 40). An example method of using a plurality of walls to assemble the cofferdam near the culvert 18 includes providing a plurality of walls (e.g., 20, 30, 40). Each wall of the plurality of walls includes a first coupler (e.g., 27, 37, 47) near a first end (e.g., 23, 33, 43) of the wall, a second coupler (e.g., 28, 38, 48) near a second end (e.g., 24, 34, 44) of the wall and a lower edge (e.g., 21, 31, 41). Selecting one wall of the plurality of walls as a selected wall. Positioning the selected wall vertically. Pressing downward on the selected wall to drive the lower edge of the selected wall into the ground surface 16. The above steps position the first wall (e.g., the first wall 20) of the cofferdam.

The example method continues by identifying the selected wall as a previously positioned wall. Selecting a next wall of the plurality of walls as the selected wall. Positioning the selected wall vertically and above the previously positioned wall so that the first coupler of the selected wall aligns with the second coupler of the previously positioned wall. Lowering the selected wall to slidably couple the first coupler of the selected wall with the second coupler of the previously positioned wall. Pressing downward on the selected wall to drive the lower edge of the selected wall into the ground surface 16.

The above consecutive steps of identifying, selecting, positioning, lowering and pressing are repeated in order until at least three of the walls of the plurality of walls are assembled thereby forming an enclosure around an inlet of the culvert 18 that prevents passage of the water 12 from a body of water 10 into an interior of the enclosure.

As the next wall is selected from the plurality of walls, the next wall may be selected so that the first coupler of the selected wall couples with the second coupler of the previously positioned wall. In other words, if the second coupler of the previously positioned wall is the male coupler 50, the first coupler of the selected wall is a female coupler 60 or vice versa.

Further, the walls are selected from the plurality of walls so that the slots 68 any female couplers 60 appropriately position the walls. Preferably the slots 68 of the female couplers 60 position the walls to form a U-shape so the interior of the cofferdam surrounds the culvert 18.

J. Assembling a Cofferdam Using Three Walls and Two Connectors.

A cofferdam may be assembled using three walls (e.g., 20, 30, 40) and two connectors (e.g., 80, 90). An example method of assembling a cofferdam near the culvert 18 includes positioning the first wall 20 vertically and near the first side of an inlet of the culvert 18. The first wall includes the first coupler 27 near the first end 23 of the first wall 20. Pressing downward on the first wall 20 to drive the lower edge 21 of the first wall 20 into the ground surface 16.

Positioning the first connector 80 vertically and above the first wall 20, the first connector 80 includes a first coupler 82 and a second coupler 84. Positioning the first connector 80 to align the first coupler 82 of the first connector 80 with the first coupler 37 of the first wall 20. Lowering the first connector 80 to slidably couple the first coupler 82 of the first connector 80 with the first coupler 27 of the first wall 20. Pressing downward on the first connector 80 to drive the lower edge of the first connector 80 into the ground surface 16.

Following placement of the first wall 20 and the first connector 80, positioning the second wall 30 vertically and above the first connector 80. The second wall 30 includes the first coupler 37 near the first end 33 of the second wall 30 and a second coupler 38 near the second end 34 of the second wall 30. Positioning the second wall 30 aligns the first coupler 37 of the second wall 30 with the second coupler 84 of the first connector 80. Lowering the second wall 30 to slidably couple the first coupler 37 of the second wall 30 with the second coupler 84 of the first connector 80. Pressing downward on the second wall 30 to drive the lower edge 31 of the second wall 30 into the ground surface 16.

With the second wall 30 in place, the second connector 90 may be placed. Positioning a second connector 90 vertically and above the second wall 30. The first connector 80 includes a first coupler 92 and a second coupler 94. Positioning the second connector 90 aligns the first coupler 92 of the second connector 90 with the second coupler 38 of the second wall 30. Lowering the second connector 90 to slidably couple the first coupler 92 of the second connector 90 with the second coupler 38 of the second wall 30. Pressing downward on the second connector 90 to drive the lower edge of the second connector 90 into the ground surface 16.

With the second connector 90 in place, the method continues with positioning the third wall 40 vertically and above the second connector 90. The third wall 40 includes the first coupler 47 near the first end 43 of the third wall 40. Positioning the third wall 40 aligns the first coupler 47 of the third wall 40 with the second coupler 94 of the second connector 90. Lowering the third wall 40 to slidably couple the first coupler 47 of the third wall 40 with the second coupler 94 of the second connector 90. Pressing downward on the third wall 40 to drive the lower edge 41 of the third wall 40 into the ground surface 16 thereby forming an enclosure around the inlet of the culvert 18 that prevents passage of the water 12 from the body of water 10 into an interior of the enclosure.

In the example method of assembling a cofferdam using the first wall 20, the second wall 30, the third wall 40, the first connector 80 and the second connector 90, the steps of positioning positions (e.g., places, ranges) the first wall 20, the first connector 80, the second wall 30, the second connector 90 and the third wall 40 in a U-shape from the first side of the inlet of the culvert 18 to the second side of the inlet of the culvert 18.

As discussed above, the male coupler 50 couples with the female couplers 60. So, in an example embodiment, first coupler 27 of the first wall 20 comprises the male coupler 50 and first coupler 82 of the first connector 80 comprises the female coupler 60. The second coupler 84 of the first connector 80 comprises the male coupler 50 and first coupler 37 of the second wall 30 comprises the female coupler 60.

In another example embodiment, the first coupler 27 of the first wall 20 comprises the female coupler 60 and the first coupler 82 of the first connector 80 comprises the male coupler 50. The second coupler 84 of the first connector 80 comprises the female coupler and first coupler 37 of the second wall comprises the male coupler. The first coupler 27 of the first wall 20 may be either the male coupler 50 or the female coupler 60 so long as it complements the first coupler 82 of the first connector 80.

In the example method, positioning the first wall 20 comprises lifting the first wall 20 using a piece of construction equipment, such as the excavator 11. Positioning the first connector 80 comprises lifting the first connector 80 using a piece of construction equipment, also such as the excavator 11. The second wall 30 and the third wall 40 may also be positioned by be lifted by the excavator 11.

In the example method, lowering the first connector 80 to slidably couple the first coupler 82 of the first connector 80 with the first coupler 27 of the first wall 20 comprises engaging the first coupler 82 of the first connector 80 with the first coupler 27 of the first wall 20 and sliding the first coupler 82 of the first connector 80 along a length of the first coupler 27 of the first wall 20.

With respect to the second wall 30 and the first coupler 82 of the first connector 80, lowering the second wall 30 to slidably couple the first coupler 37 of the second wall 30 with the second coupler 84 of the first connector 80 comprises engaging the first coupler 37 of the second wall 30 with the second coupler 84 of the first connector 80 and sliding the first coupler 37 of the second wall 30 along a length of the second coupler 84 of the first connector 80.

As discussed above, engaging includes the male coupler 50 entering the channel 67 of the female coupler 60. Sliding includes the male coupler 50 moving along (e.g., sliding) along the length of the channel 67 of the female coupler 60.

The seal formed between the first and the second example embodiments of the male coupler 50 and the female coupler 60 or discussed above. The same ceiling occurs between the couplers 82, 84, 92 and 94 of the connectors 80 and 90, and the couplers 27, 37, 38, and 47 of the walls 20, 30 and 40. For example, slidably coupling the first coupler 82 of the first connector 80 to the first coupler 27 of the first wall 20 forms a seal along the length of the first coupler 82 of the first connector 80 and along the length of the first coupler 27 of the first wall 20 that prevents passage of the water 12 from the body of water 10 into the interior of the enclosure formed by the cofferdam.

K. Assembling a Cofferdam Using a Plurality of Walls and Connectors.

A cofferdam may be assembled using a plurality of walls (e.g., 20) and a plurality of connectors (e.g., third connector 100). An example method of using a plurality of the first walls 20 and the third connectors 100 to assemble the cofferdam near the culvert 18 includes providing a plurality of first walls 20, wherein each first wall 20 of the plurality of first walls 20 includes a first coupler 27 near the first end 23 of the first wall 20, the second coupler 28 near a second end 24 of the first wall 20, and a lower edge 21. Providing a plurality of the third connectors 100, wherein each third connector 100 of the plurality of the third connectors 100 includes a plurality of couplers (e.g., 101-108), and a lower edge.

The example method begins with selecting one wall 20 of the plurality of walls as a selected first wall 20, positioning the selected first wall 20 vertically, and pressing downward on the selected first wall 20 to drive the lower edge 21 of the selected wall into the ground surface 16.

Once the first wall 20 is positioned, the repetitive portion of the method begins with identifying the selected first wall 20 as a previously positioned first wall 20. Selecting a next third connector 100 of the plurality of connectors as the selected connector. Positioning the selected third connector 100 vertically and above the previously positioned first wall 20. Positioning the selected third connector 100 aligns a first coupler (e.g., 101-108) of the plurality of the selected third connector 100 with the second coupler 28 of the previously positioned first wall 20. Lowering the selected third connector 100 to slidably couple the first coupler (e.g., 101-108) of the selected connector 100 with the second coupler 28 of the previously positioned wall 20. Pressing downward on the selected third connector 100 to drive the lower edge of the selected third connector 100 into the ground surface 16. Identifying the selected third connector 100 as a previously positioned third connector 100.

The example method continues with selecting a next first wall 20 of the plurality of the first walls 20 as the selected first wall 20. Positioning the selected first wall 20 vertically and above the previously positioned third connector 100. Positioning the selected first wall 20 aligns the first coupler 27 of the selected first wall 20 with a second coupler (e.g., 101-108) of the plurality of the previously positioned third connector 100. Lowering the selected first wall 20 to slidably couple the first coupler 27 of the selected first wall 20 with the second coupler e.g., 101-108) of the previously positioned connector 100. Pressing downward on the selected first wall 20 to drive the lower edge 21 of the selected first wall 20 into the ground surface 16.

The repeating portion of the example method includes repeating the consecutive steps of identifying, selecting, positioning, lowering, pressing, identifying, selecting, positioning, lowering and pressing in order until at least three the first walls 20 of the plurality of first walls 20 and at least two of the third connectors 100 of the plurality of the third connectors 100 are assembled thereby forming an enclosure around the inlet of the culvert 18 that prevents passage of the water 12 from the body of water 10 into an interior of the enclosure.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A method for assembling a cofferdam near a culvert, the method comprising:

positioning a first wall vertically and near a first side of an inlet of the culvert, wherein the first wall includes a first coupler near a first end of the first wall, wherein the first coupler of the first wall comprises a round protrusion;

pressing downward on the first wall to drive a lower edge of the first wall into a ground surface;

positioning a second wall vertically and above the first wall, wherein the second wall includes a first coupler near a first end of the second wall and a second coupler near a second end of the second wall, whereby the first coupler of the second wall is aligned with the first coupler of the first wall, wherein the first coupler of the second wall comprises a first C-shaped receiver, wherein an angle between a slot of the first C-shaped receiver and an interior side of the second wall is about 90 degrees, wherein the second coupler of the second wall comprises a second C-shaped receiver, wherein an angle between a slot of the second C-shaped receiver and the interior side of the second wall is about 90 degrees;

lowering the second wall to slidably couple the first coupler of the second wall with the first coupler of the first wall, whereby the slot of the first C-shaped receiver positions the second wall orthogonally to the first wall;

pressing downward on the second wall to drive a lower edge of the second wall into the ground surface;

positioning a third wall vertically and above the second wall, wherein the third wall includes a first coupler near a first end of the third wall, whereby the first coupler of the third wall is aligned with the second coupler of the second wall, wherein the first coupler of the third wall comprises a round protrusion;

lowering the third wall to slidably couple the first coupler of the third wall with the second coupler of the second wall, whereby the slot of the second C-shaped receiver positions the third wall orthogonally to the second wall; and pressing downward on the third wall to drive a lower edge of the third wall into the ground surface thereby forming an enclosure around the inlet of the culvert that prevents passage of water from a body of water into an interior of the enclosure.

2. The method of claim 1, wherein positioning comprises positioning the first wall, the second wall and the third wall in a U-shape from the first side of the inlet of the culvert to a second side of the inlet of the culvert.

3. The method of claim 1, wherein lowering the second wall to slidably couple the first coupler of the second wall with the first coupler of the first wall comprises positioning first C-shaped receiver around the round protrusion of the first wall, moving the second wall to position the first wall between a first edge and a second edge of the slot of the first C-shaped receiver, and lowering the second wall to slide the first C-shaped receiver along a length of the round protrusion.

4. The method of claim 1, wherein lowering the third wall to slidably couple the first coupler of the third wall with the second coupler of the second wall comprises positioning the round protrusion of the third wall in the second C-shaped receiver, moving the third wall to position the third wall between a first edge and a second edge of the slot of the second C-shaped receiver, and lowering the third wall to slide the round protrusion along a length of the second C-shaped receiver.

5. The method of claim 1, wherein slidably coupling the first coupler of the first wall to the first coupler of the second wall forms a seal along a length of the first coupler of the first wall and along a length of the first coupler of the second wall that prevents passage of water from the body of water into the interior of the enclosure.

6. The method of claim 1, wherein the slot of the first C-shaped receiver comprises a first edge and a second edge, wherein the first wall is adapted to be positioned between the first edge and the second edge to position the second wall orthogonally to the first wall.

7. The method of claim 1, wherein the slot of the second C-shaped receiver comprises a first edge and a second edge, wherein the third wall is adapted to be positioned between the first edge and the second edge to position the third wall orthogonally to the second wall.

8. The method of claim 1, wherein the first wall is straight between the first end of the first wall and a second end of the first wall, wherein the second wall is straight between the first end of the second wall and the second end of the second wall, and wherein the third wall is straight between the first end of the third wall and a second end of the third wall.

9. A method for assembling a cofferdam near a culvert, the method comprising:

positioning a first wall vertically and near a first side of an inlet of the culvert, wherein the first wall includes a first coupler near a first end of the first wall, wherein the first coupler of the first wall comprises a round protrusion;

pressing downward on the first wall to drive a lower edge of the first wall into a ground surface;

positioning a second wall vertically and above the first wall, wherein the second wall includes a first coupler near a first end of the second wall and a second coupler near a second end of the second wall, whereby the first coupler of the second wall is aligned with the first coupler of the first wall, wherein the first coupler of the second wall comprises a first C-shaped receiver, wherein an angle between a slot of the first C-shaped receiver and an interior side of the second wall is about 90 degrees, wherein the second coupler of the second wall comprises a round protrusion;

lowering the second wall to slidably couple the first coupler of the second wall with the first coupler of the first wall, whereby the slot of the first C-shaped receiver positions the second wall orthogonally to the first wall;

pressing downward on the second wall to drive a lower edge of the second wall into the ground surface;

positioning a third wall vertically and above the second wall, wherein the third wall includes a first coupler near a first end of the third wall, whereby the first coupler of the third wall is aligned with the second coupler of the second wall, wherein the first coupler of the third wall comprises a second C-shaped receiver, wherein an angle between a slot of the second C-shaped receiver and an interior side of the third wall is about 90 degrees;

lowering the third wall to slidably couple the first coupler of the third wall with the second coupler of the second wall, whereby the slot of the second C-shaped receiver positions the third wall orthogonally to the second wall; and pressing downward on the third wall to drive a lower edge of the third wall into the ground surface thereby forming an enclosure around the inlet of the culvert that prevents passage of water from a body of water into an interior of the enclosure.

10. The method of claim 9, wherein the slot of the first C-shaped receiver comprises a first edge and a second edge, wherein the first wall is adapted to be positioned between the first edge and the second edge to position the second wall orthogonally to the first wall.

11. The method of claim 9, wherein the slot of the second C-shaped receiver comprises a first edge and a second edge, wherein the second wall is adapted to be positioned between the first edge and the second edge to position the third wall orthogonally to the second wall.

12. The method of claim 9, wherein lowering the second wall to slidably couple the first coupler of the second wall with the first coupler of the first wall comprises positioning first C-shaped receiver around the round protrusion of the first wall, moving the second wall to position the first wall between a first edge and a second edge of the slot of the first C-shaped receiver, and lowering the second wall to slide the first C-shaped receiver along a length of the round protrusion.

13. The method of claim 9, wherein lowering the third wall to slidably couple the first coupler of the third wall with the second coupler of the second wall comprises positioning second C-shaped receiver around the round protrusion of the second wall, moving the third wall to position the second wall between a first edge and a second edge of the slot of the second C-shaped receiver, and lowering the third wall to slide the second C-shaped receiver along a length of the round protrusion.

14. The method of claim 9, wherein the first wall is straight between the first end of the first wall and a second end of the first wall, wherein the second wall is straight between the first end of the second wall and the second end of the second wall, and wherein the third wall is straight between the first end of the third wall and a second end of the third wall.

15. A method for assembling a cofferdam near a culvert, the method comprising:

positioning a first wall vertically and near a first side of an inlet of the culvert, wherein the first wall includes a first coupler near a first end of the first wall, wherein the first coupler of the first wall comprises a first C-shaped receiver, wherein an angle between a slot of the first C-shaped receiver and an interior side of the first wall is about 90 degrees;

pressing downward on the first wall to drive a lower edge of the first wall into a ground surface;

positioning a second wall vertically and above the first wall, wherein the second wall includes a first coupler near a first end of the second wall and a second coupler near a second end of the second wall, whereby the first coupler of the second wall is aligned with the first coupler of the first wall, wherein the first coupler of the second wall comprises a first round protrusion, wherein the second coupler of the second wall comprises a second round protrusion;

lowering the second wall to slidably couple the first coupler of the second wall with the first coupler of the first wall, whereby the slot of the first C-shaped receiver positions the second wall orthogonally to the first wall;

pressing downward on the second wall to drive a lower edge of the second wall into the ground surface;

positioning a third wall vertically and above the second wall, wherein the third wall includes a first coupler near a first end of the third wall, whereby the first coupler of the third wall is aligned with the second coupler of the second wall, wherein the first coupler of the third wall comprises a second C-shaped receiver, wherein an angle between a slot of the second C-shaped receiver and an interior side of the third wall is about 90 degrees;

lowering the third wall to slidably couple the first coupler of the third wall with the second coupler of the second wall, whereby the slot of the second C-shaped receiver positions the third wall orthogonally to the second wall; and pressing downward on the third wall to drive a lower edge of the third wall into the ground surface thereby forming an enclosure around the inlet of the culvert that prevents passage of water from a body of water into an interior of the enclosure.

16. The method of claim 15, wherein the slot of the first C-shaped receiver comprises a first edge and a second edge, wherein the second wall is adapted to be positioned between the first edge and the second edge to position the second wall orthogonally to the first wall.

17. The method of claim 15, wherein the slot of the second C-shaped receiver comprises a first edge and a second edge, wherein the second wall is adapted to be positioned between the first edge and the second edge to position the third wall orthogonally to the second wall.

18. The method of claim 15, wherein lowering the second wall to slidably couple the first coupler of the second wall with the first coupler of the first wall comprises positioning the first round protrusion in the first C-shaped receiver, moving the second wall to position the second wall between a first edge and a second edge of the slot of the first C-shaped receiver, and lowering the second wall to slide the first round protrusion along a length of the first C-shaped receiver.

19. The method of claim 15, wherein lowering the third wall to slidably couple the first coupler of the third wall with the second coupler of the second wall comprises positioning second C-shaped receiver around the second round protrusion, moving the third wall to position the second wall between a first edge and a second edge of the slot of the second C-shaped receiver, and lowering the third wall to slide the second C-shaped receiver along a length of the second round protrusion.

20. The method of claim 15, wherein the first wall is straight between the first end of the first wall and a second end of the first wall, wherein the second wall is straight between the first end of the second wall and the second end of the second wall, and wherein the third wall is straight between the first end of the third wall and a second end of the third wall.

* * * * *